US009004282B2

(12) United States Patent
Van Ness

(10) Patent No.: US 9,004,282 B2
(45) Date of Patent: Apr. 14, 2015

(54) FOOD STORAGE BIN

(76) Inventor: William Van Ness, Saddle River, NJ (US)

( * ) Notice: Subject to any disclaimer, the term of this patent is extended or adjusted under 35 U.S.C. 154(b) by 0 days.

(21) Appl. No.: 12/228,886

(22) Filed: Aug. 15, 2008

(65) Prior Publication Data

US 2009/0050508 A1 Feb. 26, 2009

Related U.S. Application Data

(60) Provisional application No. 60/965,537, filed on Aug. 20, 2007.

(51) Int. Cl.
*B65D 43/16* (2006.01)
*B65D 21/02* (2006.01)

(52) U.S. Cl.
CPC ..... *B65D 21/0233* (2013.01); *B65D 43/16* (2013.01); *Y10S 220/908* (2013.01)

(58) Field of Classification Search
USPC ..... 206/515, 505; 220/831, 380, 908, 770, 220/832, 772, 771
See application file for complete search history.

(56) References Cited

U.S. PATENT DOCUMENTS

| | | | | |
|---|---|---|---|---|
| 2,376,487 | A * | 5/1945 | Jerry | 220/842 |
| 4,325,492 | A * | 4/1982 | Kunze | 220/831 |
| 5,445,397 | A * | 8/1995 | Evans | 280/47.18 |
| 5,758,886 | A * | 6/1998 | Mayer | 280/47.26 |
| D515,313 | S * | 2/2006 | Uffner et al. | D3/294 |
| 7,100,791 | B2 * | 9/2006 | Berger | 220/831 |
| 7,185,783 | B1 * | 3/2007 | Miller | 220/675 |
| 2003/0155366 | A1 * | 8/2003 | Raghunathan | 220/835 |
| 2003/0213808 | A1 * | 11/2003 | Berger | 220/832 |
| 2009/0107998 | A1 * | 4/2009 | Meissen | 220/254.3 |

* cited by examiner

*Primary Examiner* — Fenn Mathew
*Assistant Examiner* — Cynthia Collado
(74) *Attorney, Agent, or Firm* — Thomas A. O'Rourke; Bodner & O'Rourke, LLP

(57) ABSTRACT

A nestable container and lid are provided. A first container may be received by a second container such that the first container nests in the second container. The lid of the first container is also nestable in the open lid of the second container when the lids of the first container and the second container are opened.

10 Claims, 36 Drawing Sheets

FIG. 14A
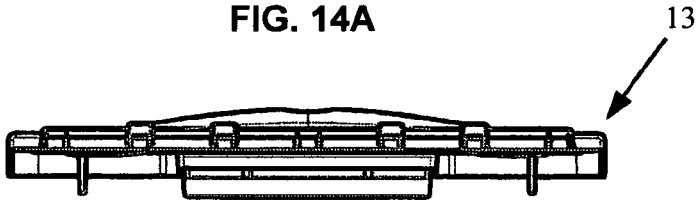
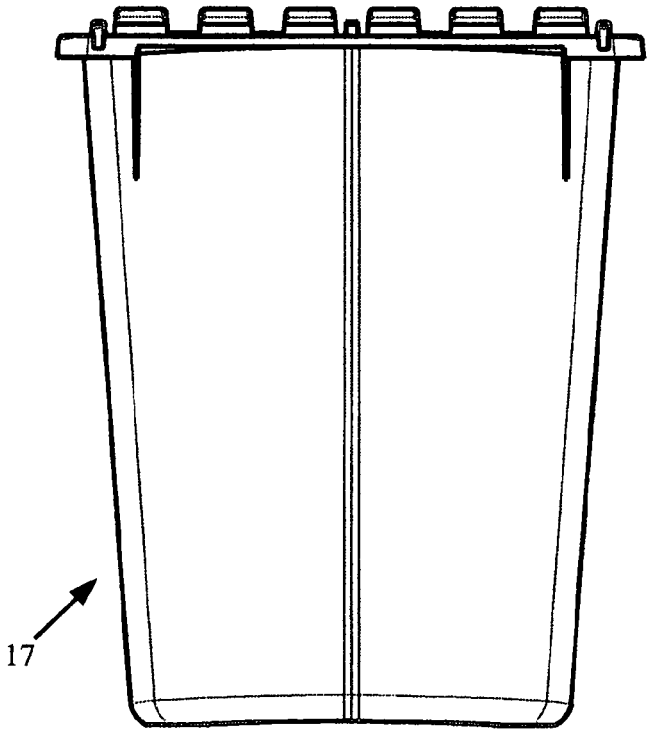
FIG. 14B

FOOD STORAGE BIN

This application claims priority on U.S. Application Ser. No. 60/965,537 filed Aug. 20, 2007, the disclosures of which are incorporated herein by reference.

FIELD OF THE INVENTION

The present invention relates generally to the field of unique food storage containers and the like, and more specifically to pet food storage containers. The containers have an attached lid and can be nested within each other for ease of transport storage and display in a retail environment.

BACKGROUND OF THE INVENTION

Pet owners with multiple or large pets buy pet food in large quantities of food which needs to be kept fresh in storage. In addition, open containers can attract bugs, rodents and other vermin. This need has given rise to may different types of large air tight containers for keeping pet food fresh.

Many of the containers available in the market have a separate lid and a container body. The problem with this configuration is in the shipping and storage on retail shelves. Many times before the product even makes it to the shelves of the retail store the pieces are separated and some may be missing. Containers may be missing lids or there may be more lids then containers. Shipping may also damage some of the lids leaving the retailer with a large quantity of containers without lids. Another problem may be theft of the lids in the stores or misplacement away from the container bodies. The retailer must now use valuable storage space until corresponding lids are shipped or replaced before the product can be put on the shelf for sale.

Another problem which arises from the prior art configuration of a separate container and lid is display on retail store shelves. Display area on retail store shelves is valuable; the retailer wants to be able to display many different types of products within the available space so that they can meet the needs of various consumer demands. In addition it is expensive both in labor for restocking and lost sales if insufficient product is on the shelves to accommodate customer needs. Another problem which arises in retailing these large bins or containers is shipping them from the manufacturer to the retailer. When shipping their product a manufacturers cost of shipment per container is affected by how many of a product can be shipped or packed in a given volume of space.

Applicant's invention resolves these storage and shipping issues by a unique arrangement of the lid and container by hinging. This eliminates the problem of missing lids or the retailer receiving a greater quantity of one piece than the other. Another important feature of Applicant's containers is that they can also be nested within each other with the lids still attached. This feature of the container will make them easier to display in retail stores, it will also make them more space efficient during shipping. This will in turn lower the cost of manufacturing offering a lower price to the retailer which can be passed on to the consumer.

SUMMARY OF THE INVENTION

Applicant's invention is a storage bin which may be made of plastic or any other suitable material. The container has a lid which attached via a hinge and cannot be easily separated from the container. The hinged lid does not interfere with the container's nesting feature. The container's hinged lid may, for example, use a piano hinge, meaning that one pin extends all the way across the hinge. Alternatively, there may be a plurality of hinges. A key feature of the present invention is that the lid of the container has a lip extending from three sides which fit over the container wall when closed. The fourth side is the side with the hinge, this side does not have a lip extending from it. The lack of this lip on the hinged side of the lid allows the lids to fold back out of the way when the containers are nested together.

Applicant's invention by allowing the containers to nest within one another makes a more efficient use of space during shipping and displaying the products. Manufacturers can save money on shipping cost while still keeping the lid and container together. Retailers can display the product without wasting any shelf display space.

OBJECT OF THE INVENTION

It is an object of the invention to provide an improved storage container for food products and the like.

It is also an object of the invention to provide a storage container with the lid attached to the container, in a manner that the lid does not interfere with the nesting of a plurality of containers.

It is a further object of the invention to provide a food storage container that can be nested in order to efficiently use available space.

It is a still further object of the invention to provide a food storage container where the body of the container nests in a corresponding body and the open lid nests in a corresponding open lid.

BRIEF DESCRIPTION OF THE DRAWINGS

FIG. 14A and FIG. 14B show the container and the lid as seen in FIG. 14, but shown separated, and just prior to being assembled together.

DETAILED DESCRIPTION

Applicant's invention is a storage bin which may be made of plastic or any other suitable material. The container and/or lid is preferably made from an injection molded thermoplastic material. The container has a lid 13 which attached via a hinge 16 and cannot be easily separated from the container. For example, the hinge 16 rotatably secures the lid 13 to the container body. The hinged lid 13 does not interfere with the container's nesting feature due to the configuration of the lid and the container.

Figure 1:
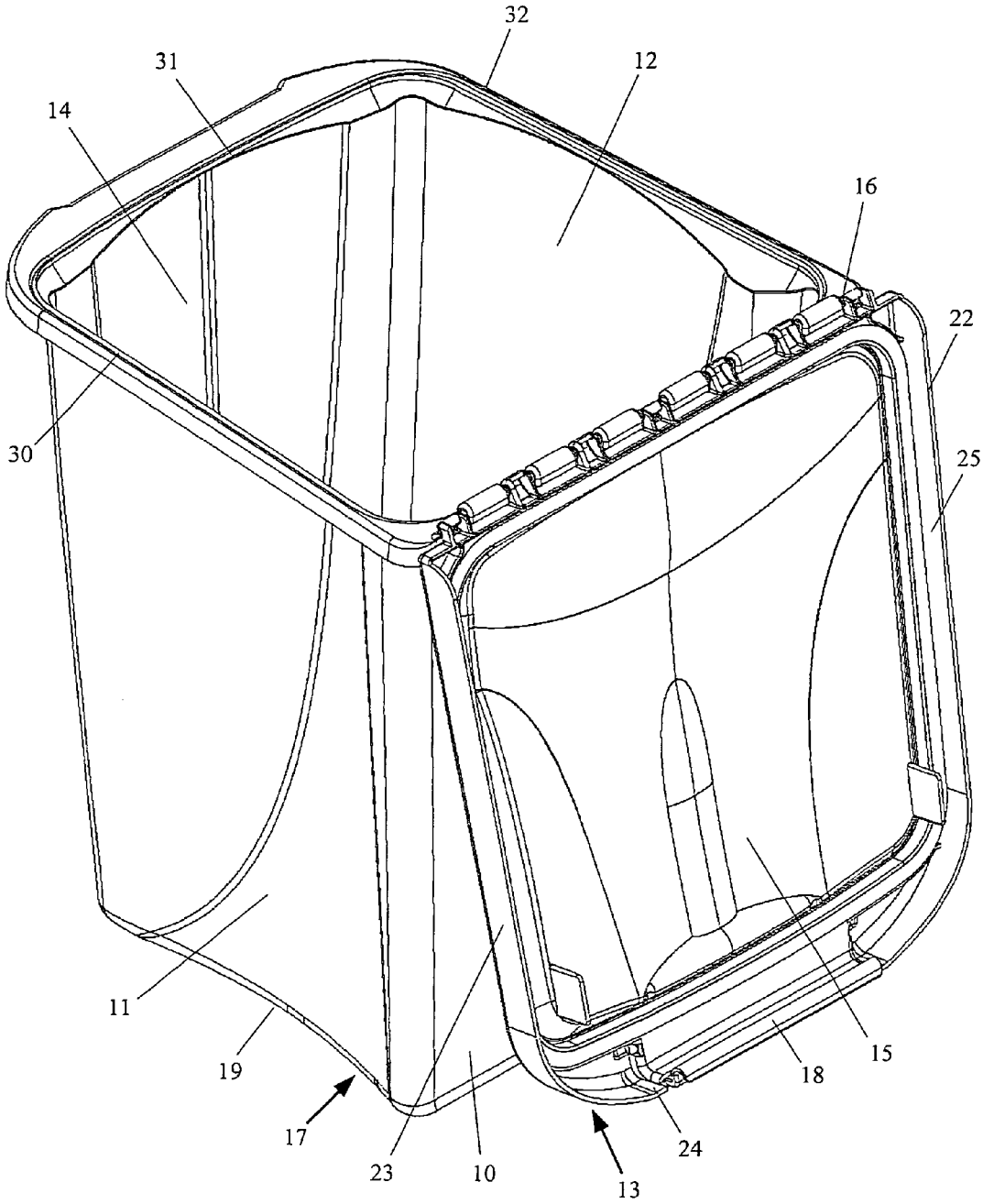
FIG. 1 shows the food storage bin with the lid open.
Figure 1A:
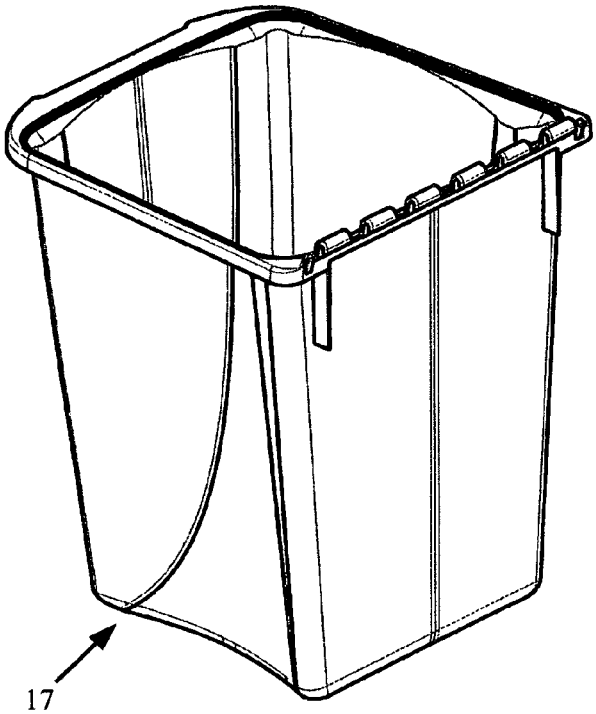
FIG. 1A and FIG. 1B show the container and the lid as seen in FIG. 1, but shown separated, and just prior to being assembled together.
Figure 1B:
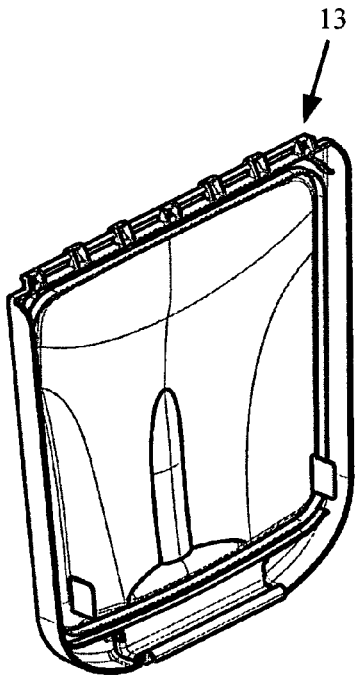
Figure 1C:
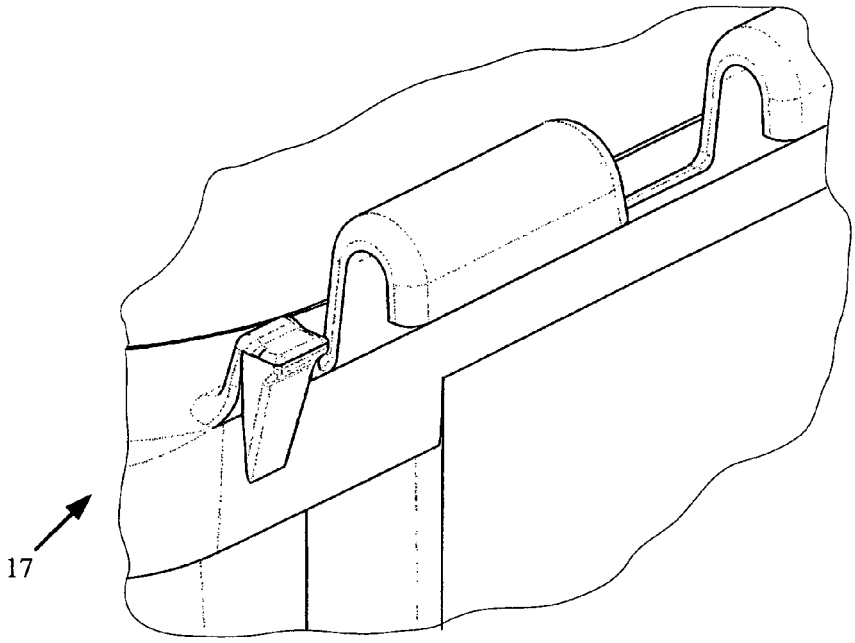
FIG. 1C is an enlarged detail view of the container of FIG. 1A.
Figure 1D:
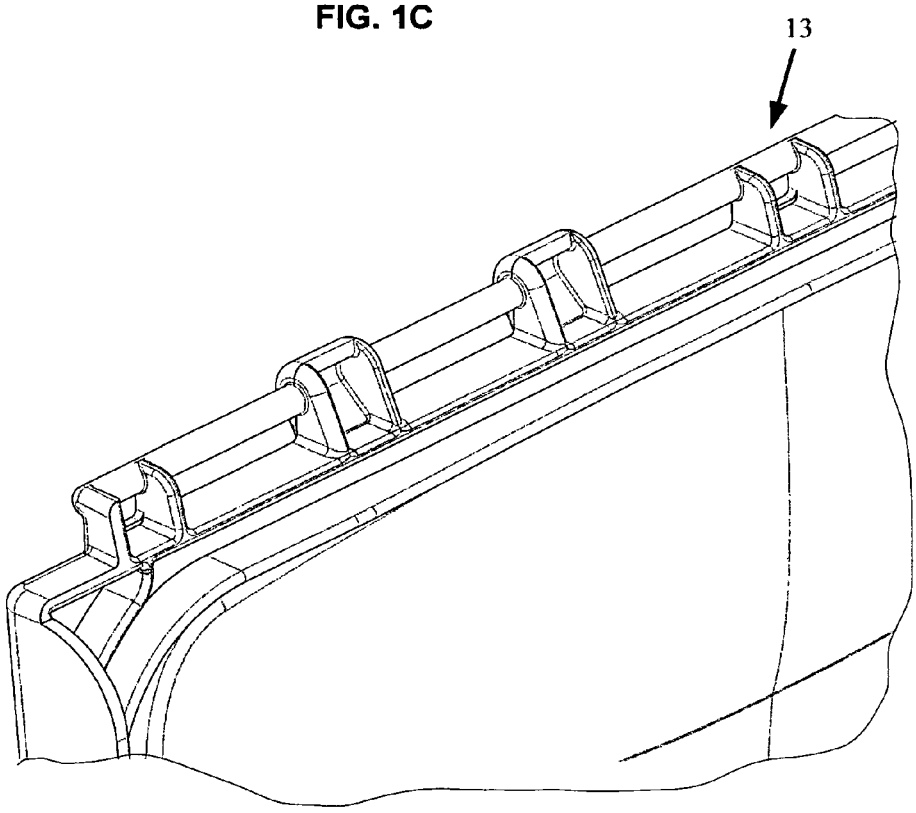
FIG. 1D is an enlarged detail view of the lid of FIG. 1B.

FIG. 1 shows the food storage bin with the lid 13 open. The bin has two sidewalls on opposite sides thereof. There is a first sidewall 11 and a second sidewall 12. There are also two end walls 10, 14 that extend from one sidewall to the other sidewall. It will be appreciated that the number, size and the configuration of the sidewalls can vary with the parameters set forth herein. The front 14 and rear 10 end walls differ from each other in that they vary in width. The front end wall 14 is shorter in width then the rear end wall 10, thus the front of the container is narrower than the rear of the container. More specifically, the distance from one front corner of the front of the container to the other front corner of the front of the container is less than the distance from one rear corner at the rear of the container to the other rear corner at the rear of the container. By the term front corner is meant the edge formed by the intersection of the front wall with a side wall. By the term rear corner is meant the edge formed by the intersection of the rear wall with a side wall. These distances are preferably measured at the top ledge of the container. However, it will be appreciated that the distance from one sidewall to the other side wall is less along the front of the container as compared to the rear of the container for any given distance above the base of the container.

In one embodiment, the length of the front end wall 14 from the first sidewall 11 to the second sidewall 12 is less in then the length of the rear end wall 10 from the first sidewall 11 to the second sidewall 12 along the entire height of the container. In another embodiment, only the top area adjacent to the top surface of the container need be a shorter distance than the top surface of the container at the rear wall where the lid is secured to the container. This tapered front of the container allows the containers to removably nest within each other. The two sidewalls 11 and 12 that connect the front 14 and rear 10 end walls may be identical to one another. The sidewalls 11 and 12 extend from the end wall to the rear end wall. The container is open at one end and has a base 19 at the other end.

The lid 13 has a top surface and a bottom surface. Extending from the bottom surface of the lid is a lip 22. The lip 22 extends from three edges 26, 27, 28 of the lid 13. There is a front lip 24 and two side lips 23 and 25. In one preferred embodiment the lip or skirt 22, extends from one or more of the edges of the lid 13. This lip 22 can extend from the side edges 26, 27 and the front edge 28. This lip 22 then fits over a lip edge 20 on the container which extends from the edges 30, 31, 32 of the container. There is no lip extending from the rear edge 29 of the lid 13. The lid 13 may be any suitable shape, in one preferred embodiment the lid 13 has a convex center portion 15, when stacking the containers within one another the center portion of the lids preferably nest into one another, allowing a better fit between the containers to occupy less space. The front portion of the lid 13 may have a locking mechanism 18 which corresponds with a mechanism at the top of the front wall 14, to secure the lid to the container. This mechanism ensures that the contents stored in the bin remain relatively fresh, and free from insects or rodents.

The lid 13 and the container 17 are connected by a hinge 16 that permits the lid to rotate from a closed position to an open position. In an open position the hinge permits the lid to lie generally along the rear sidewall 10 of the container. In a preferred embodiment the lid may be generally parallel to the rear wall of the container.

The hinge may be a piano hinge in which case a single pin is used throughout the length of the hinge 16 to connect the lid 13 and the container 17. Any other type of hinge that permits the lid to open as shown in FIG. 1 may also be used. For example there may be multiple hinges or pins 16A-16E (see FIG. 11A) used to connect the lid 13 and container 17. A key feature of the present invention is that the side of the lid 13 with the hinge 16 does not have a lip extending from the lid, which also allows the lids to slide into one another when the containers are nested. If there were a lip on the fourth side of the lid, the lip would extend outwards from the container a greater distance thereby preventing nested containers from being in a position generally downward as showing FIGS. 20-25. It would interfere when the user tried to open the lid all the way, the lid would not fully open and hang back against the rear end wall 10 of the container.

Figure 2:
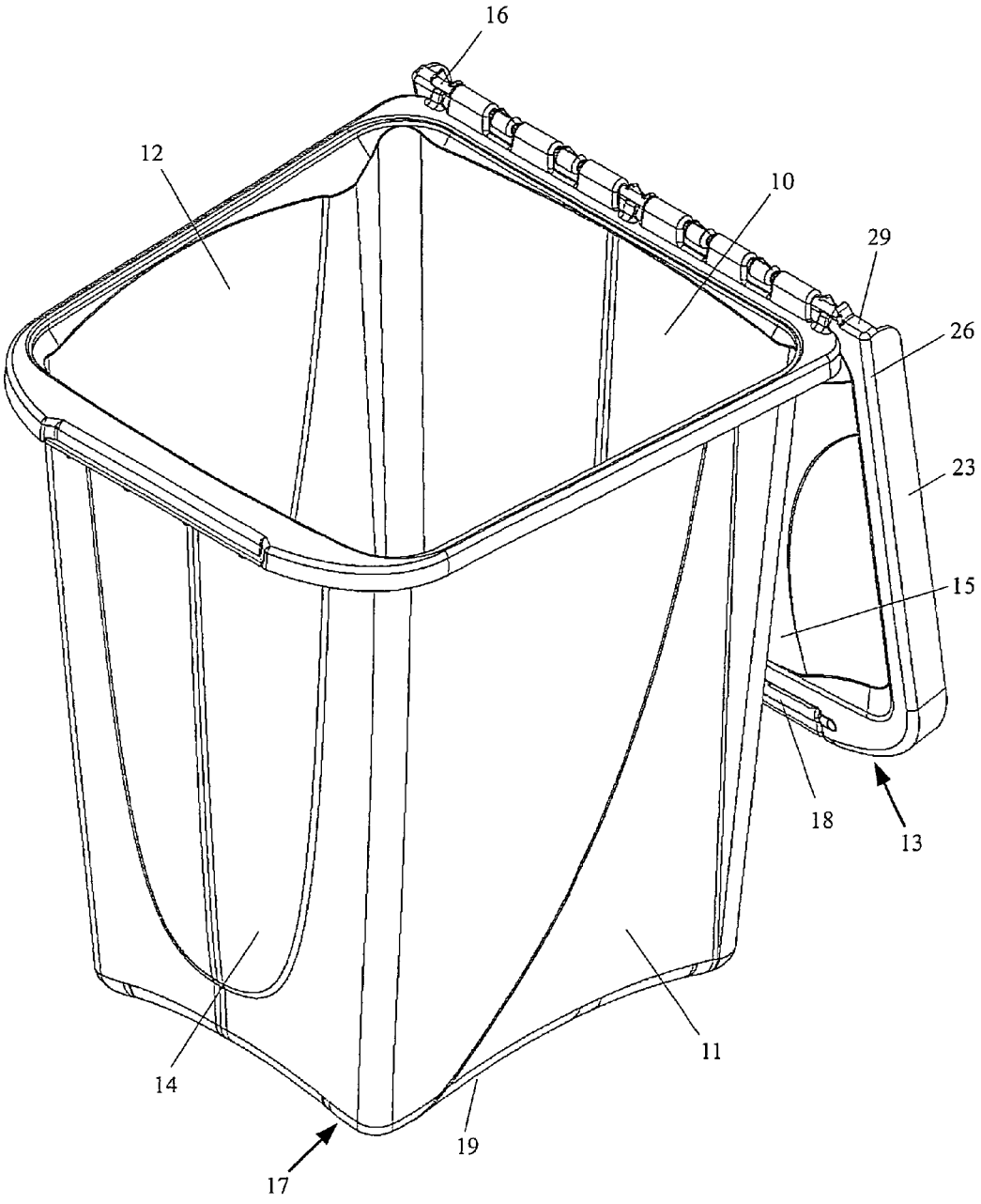
FIG. 2 is a perspective view from the front showing and first sidewall.
Figure 2B:
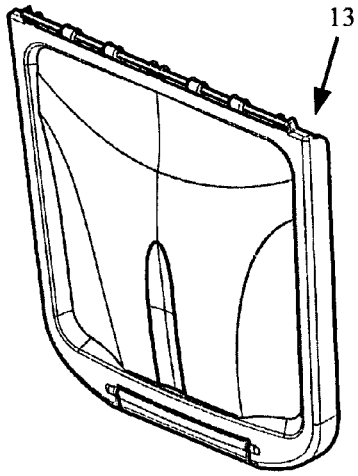
FIG. 2A and FIG. 2B show the container and the lid as seen in FIG. 2, but shown separated, and just prior to being assembled together.
Figure 2A:
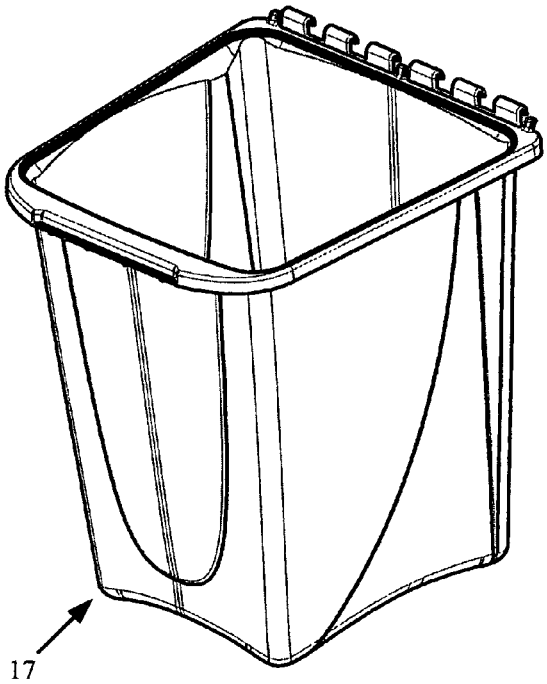
Figure 3:
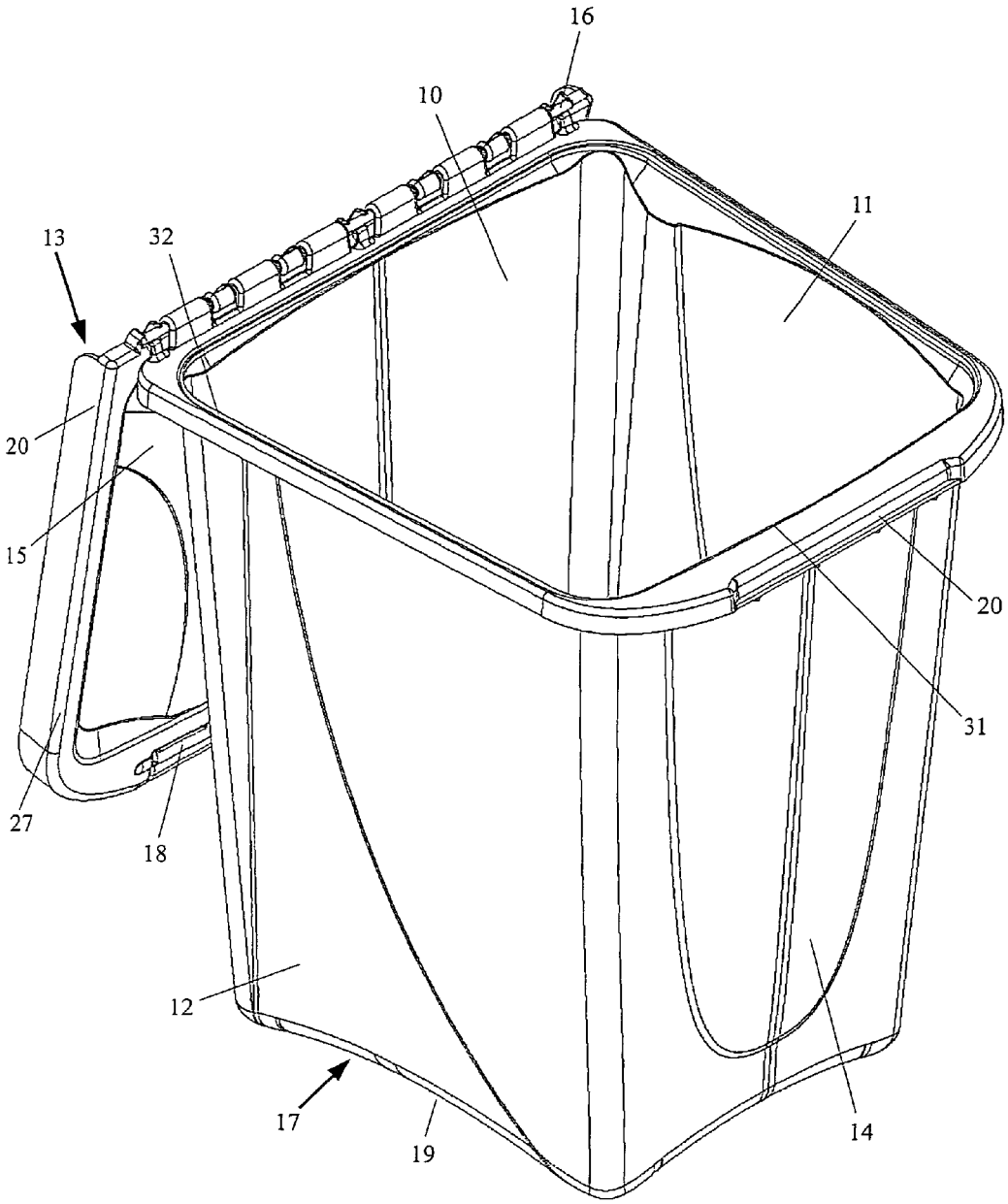
FIG. 3 is a perspective view from the front showing the second sidewall.
Figure 4:
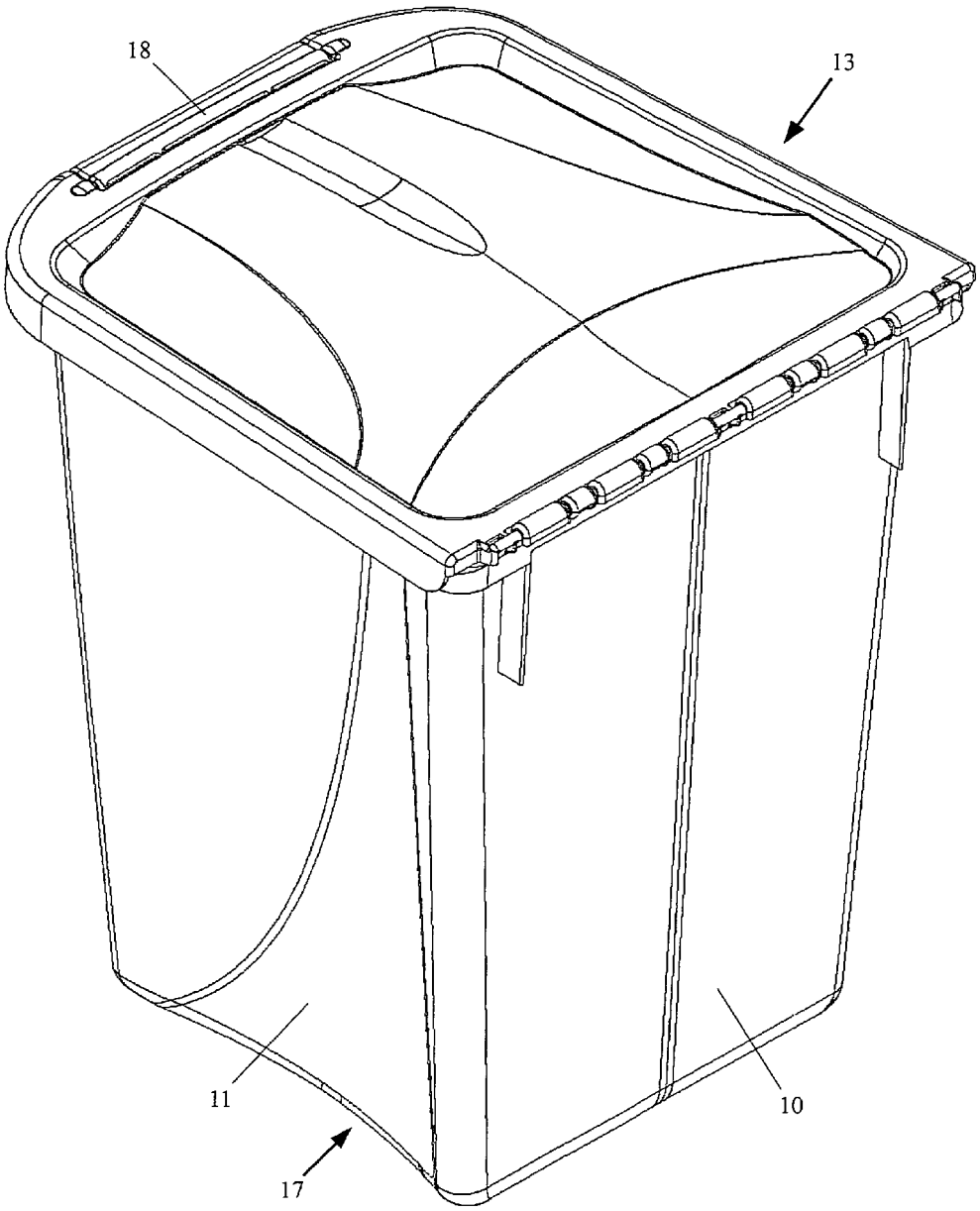
FIG. 4 is a perspective view from the back of the bin.
Figure 4A:
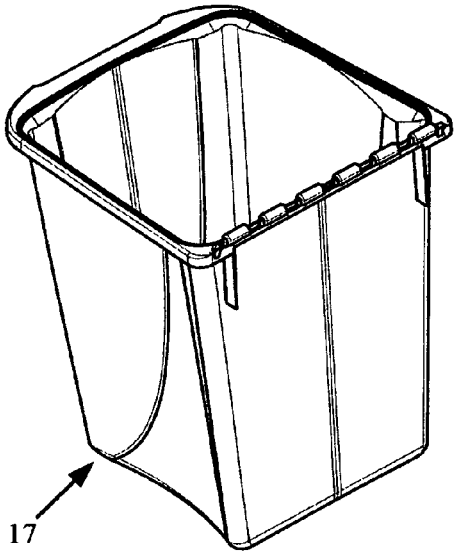
FIG. 4A and FIG. 4B show the container and the lid as seen in FIG. 4, but shown separated, and prior to being assembled together.
Figure 4B:
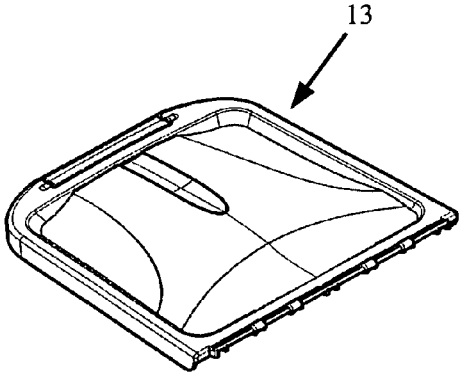
Figure 5:
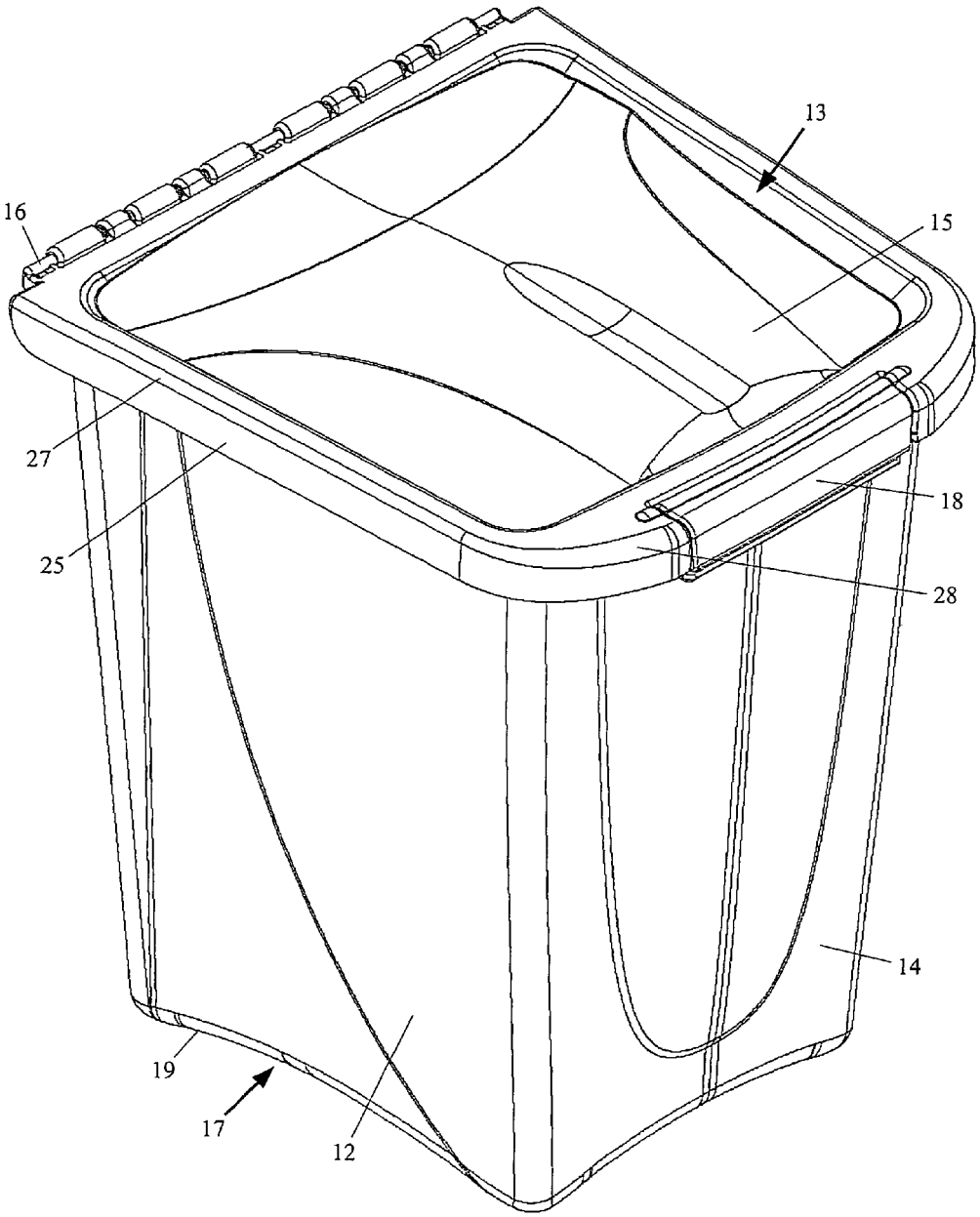
FIG. 5 is a perspective view from the front with the lid closed showing the second sidewall.
Figure 6:
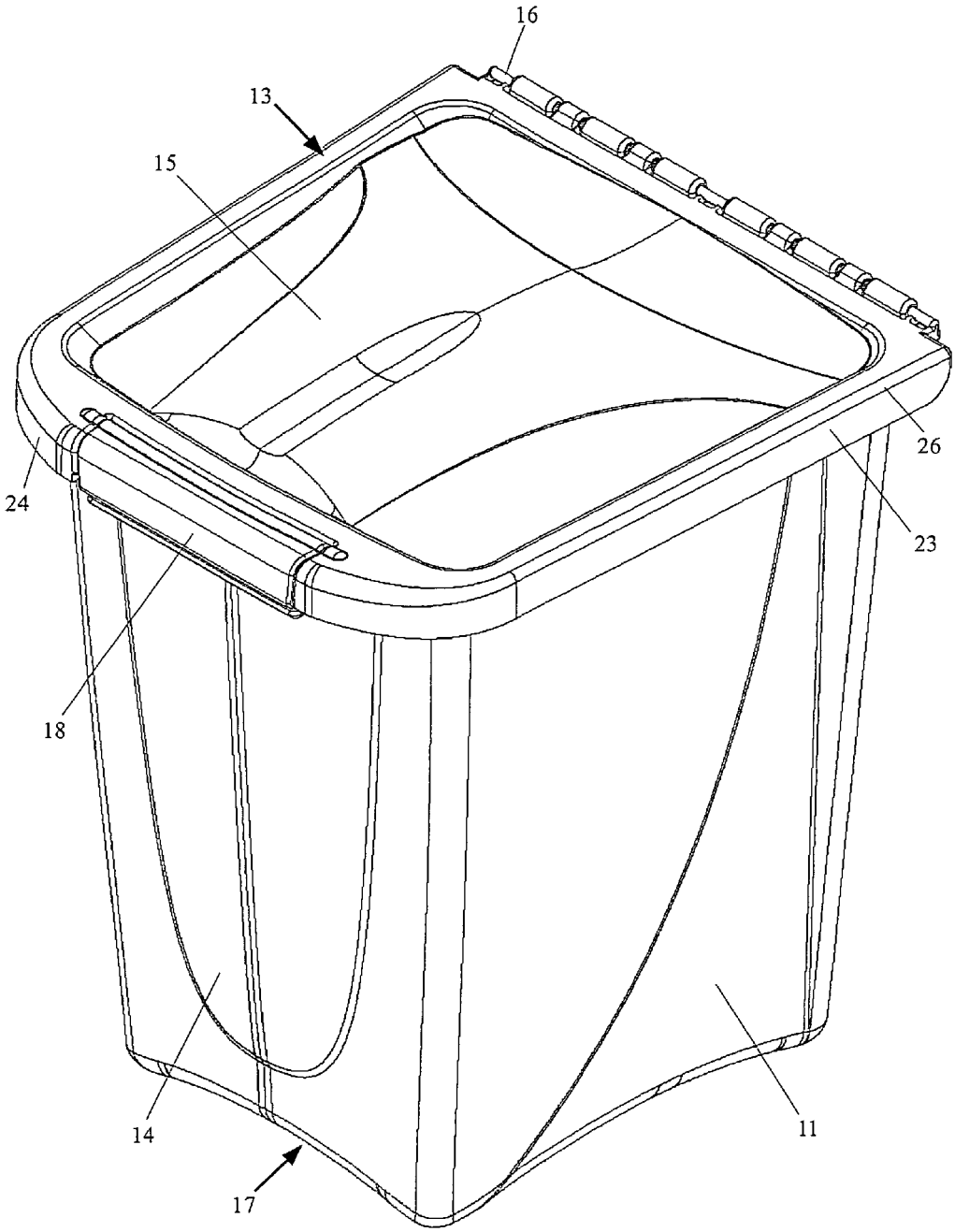
FIG. 6 is a front perspective view showing the first sidewall.
Figure 7:
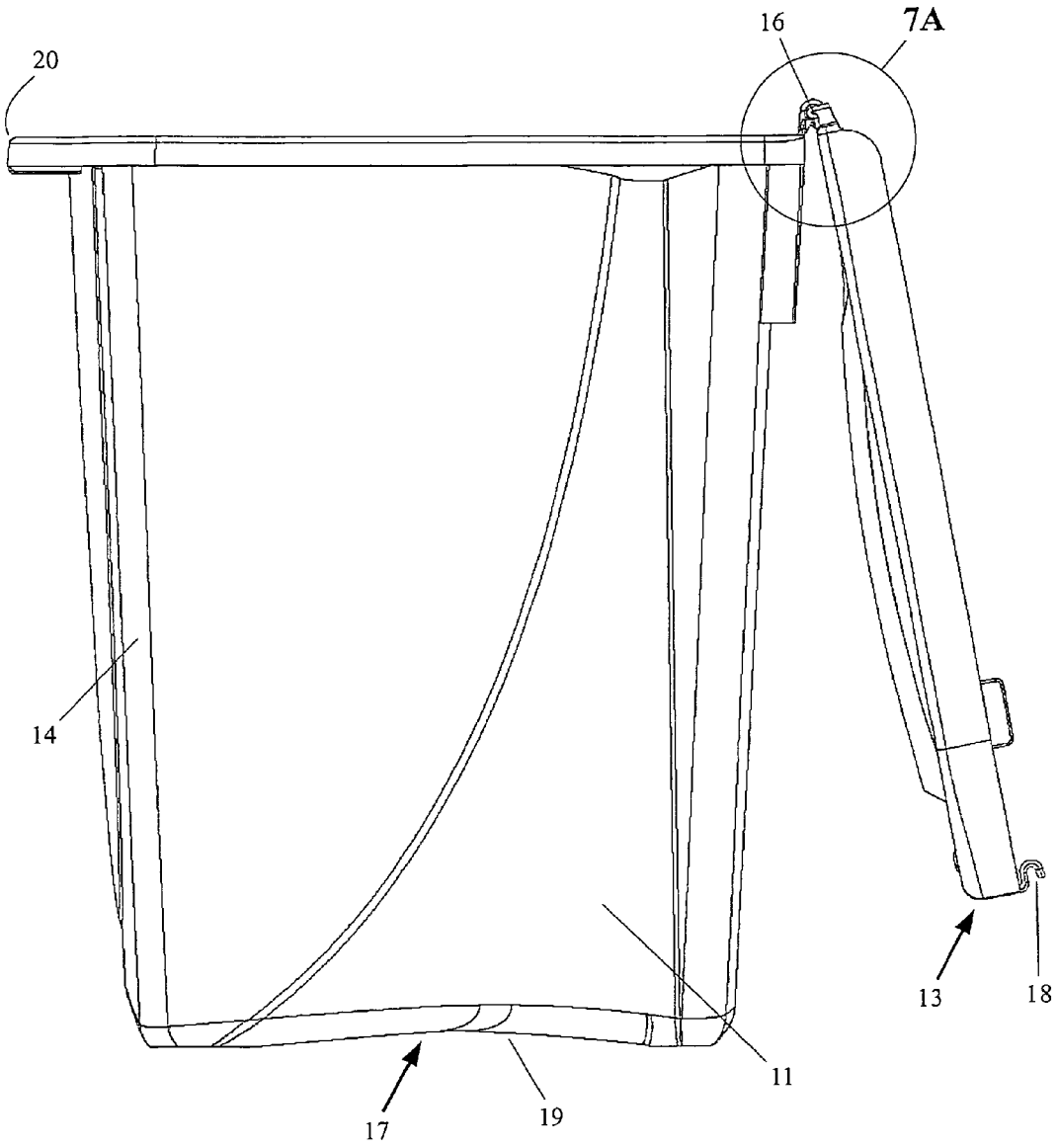
FIG. 7 is a side view of the container with the lid open.
Figure 7A:
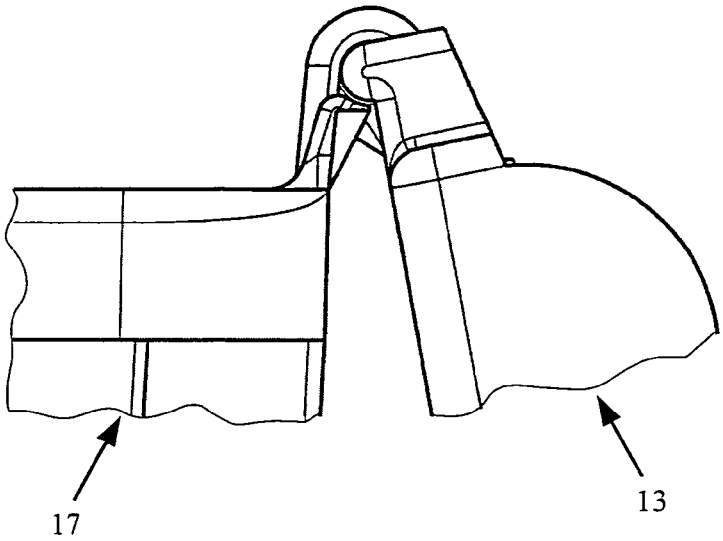
FIG. 7A is an enlarged detail view of the lid hinge of FIG. 7.
Figure 7B:
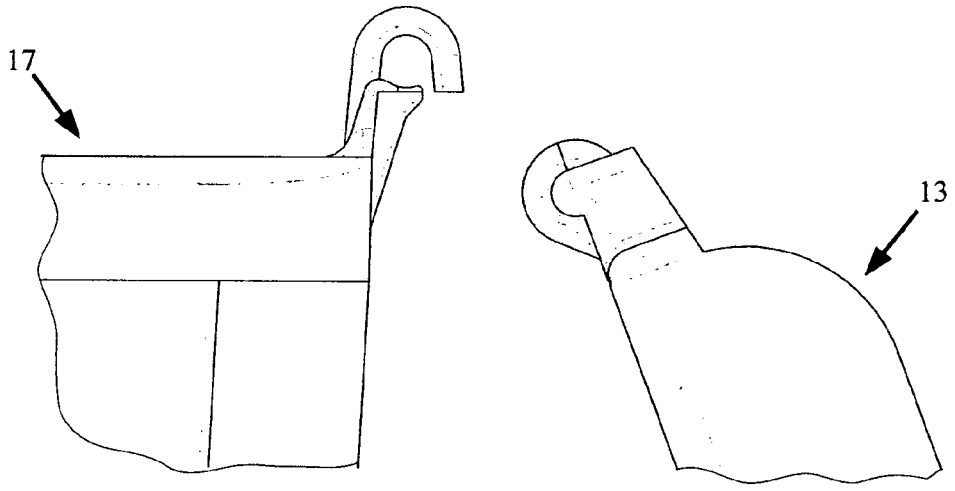
FIG. 7B shows the container and the lid as seen in FIG. 7A, but shown separated, and just prior to being assembled together.
Figure 8:
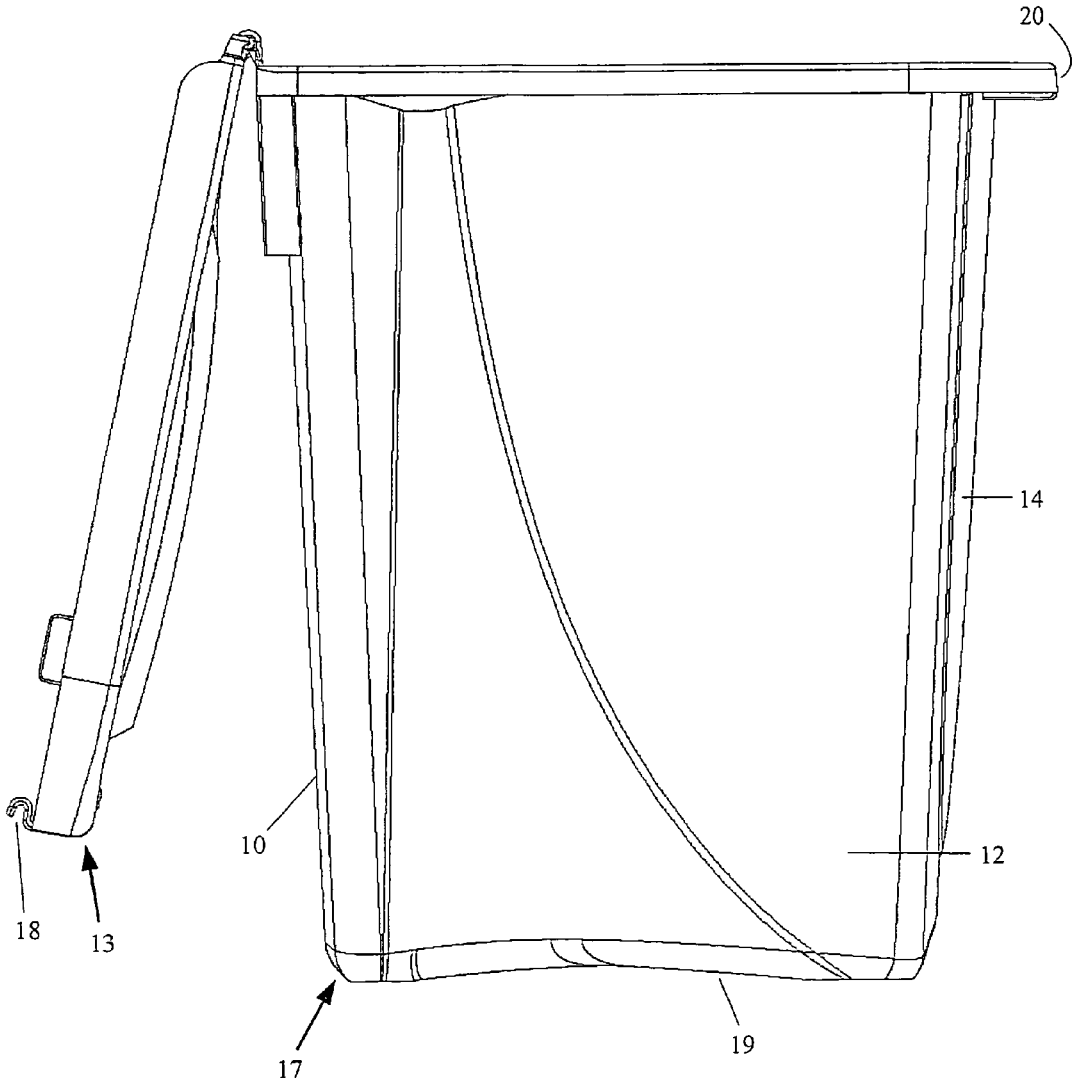
FIG. 8 is a side view of the container with the lid open.
Figure 9:
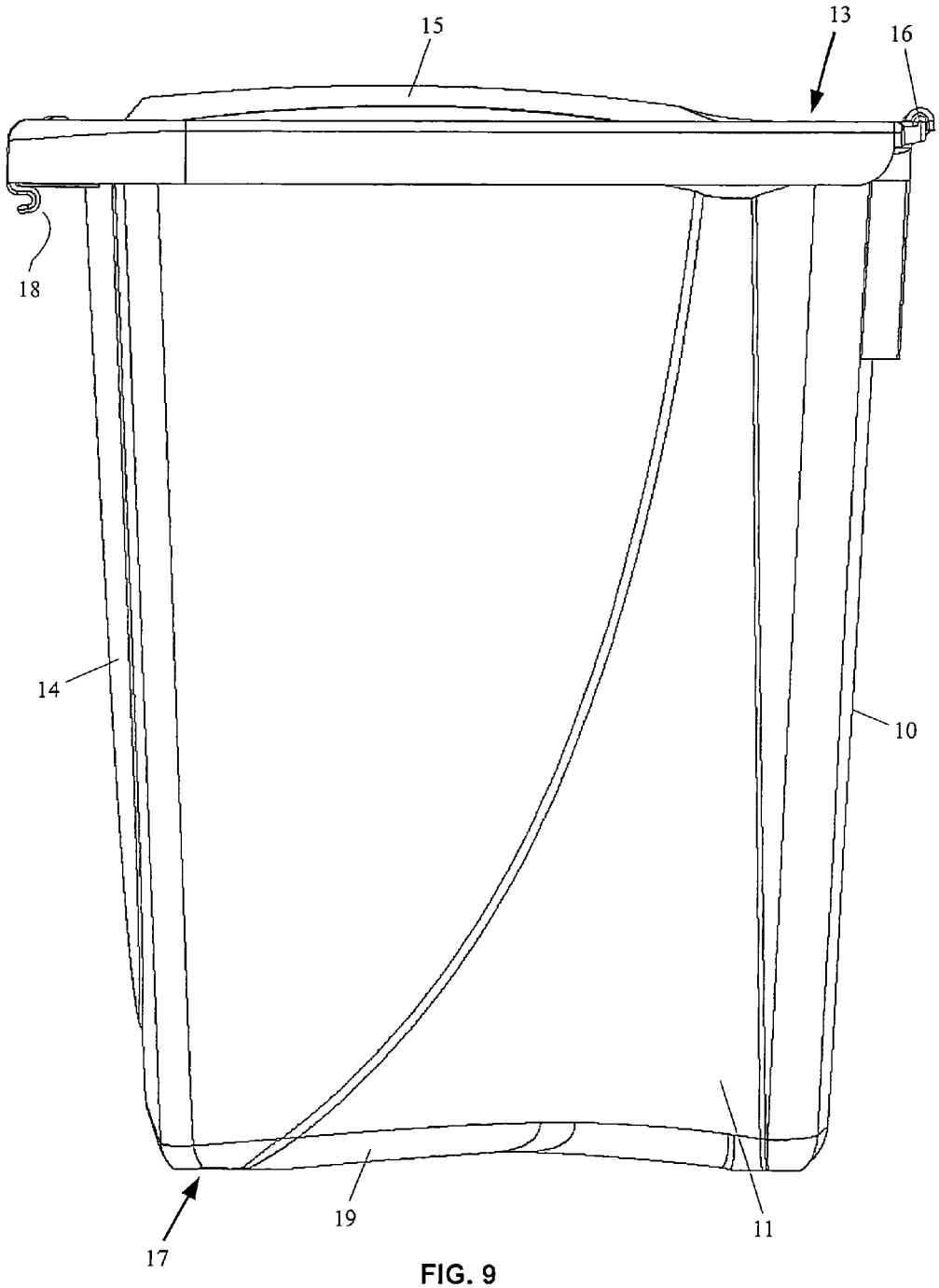
FIG. 9 is a side view of the container with the lid closed showing the first sidewall.
Figure 10:
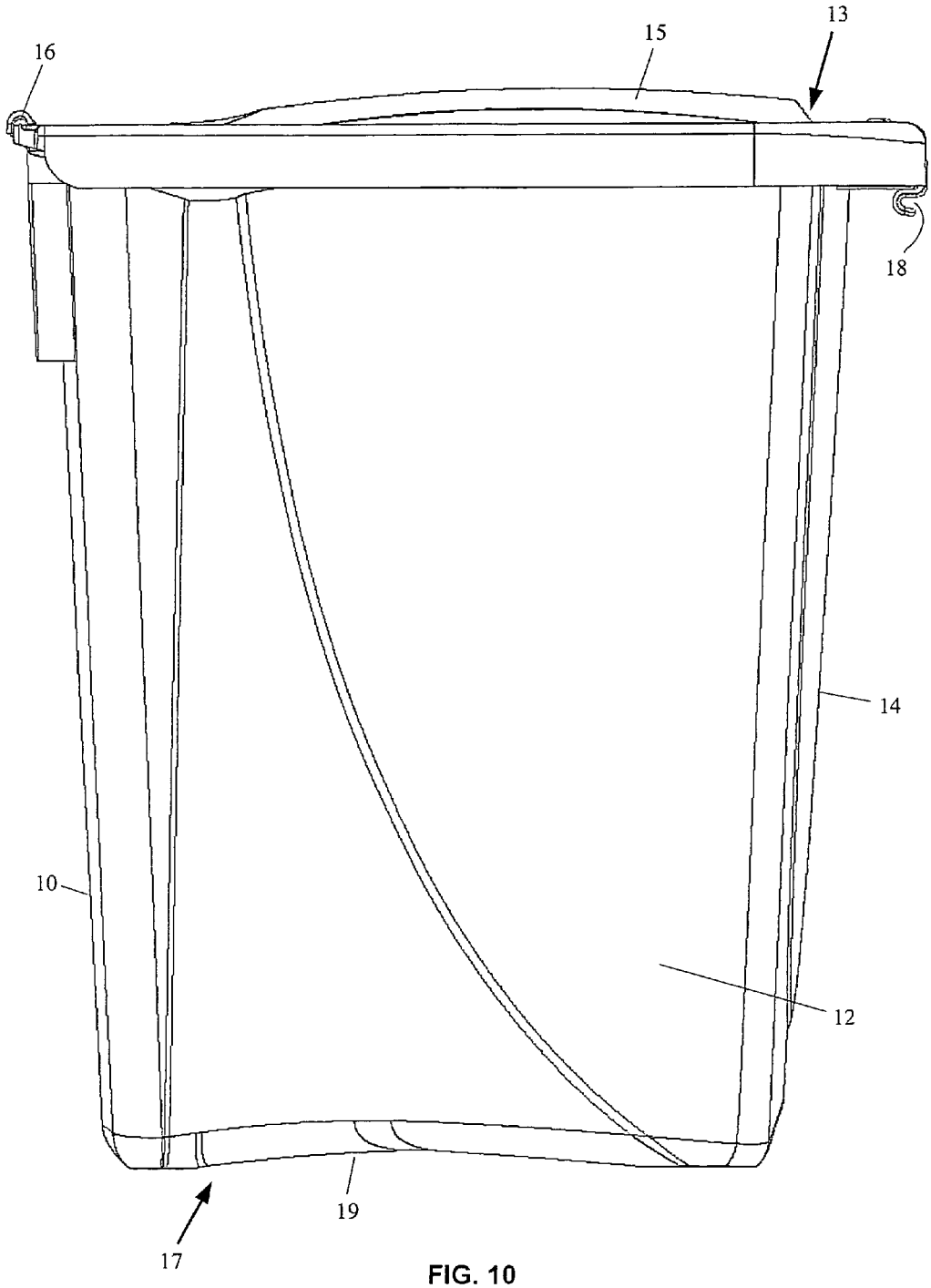
FIG. 10 is a side view of the container with the lid closed.
Figure 11:
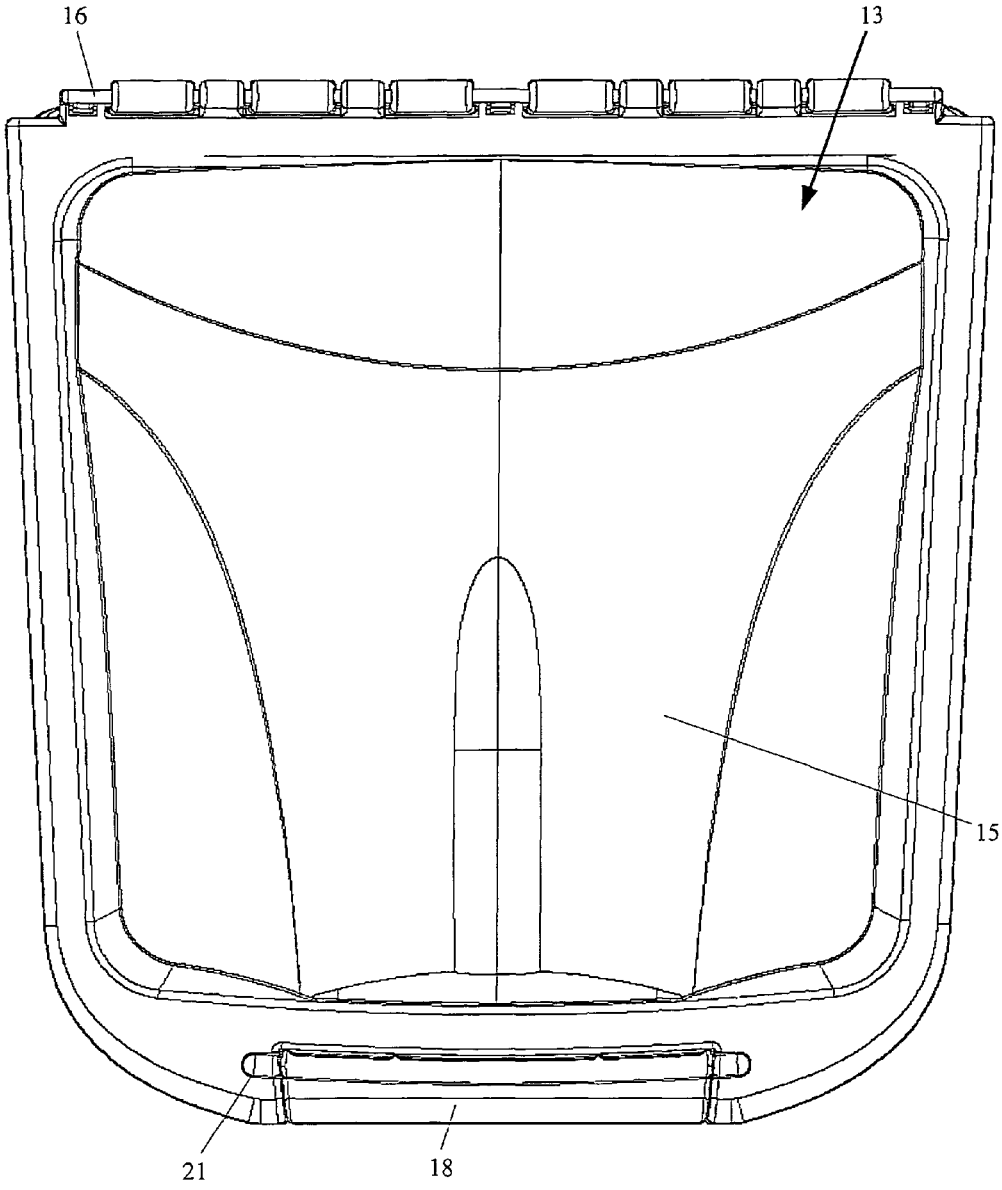
FIG. 11 is a top view of the container showing the lid closed.
Figure 11A:
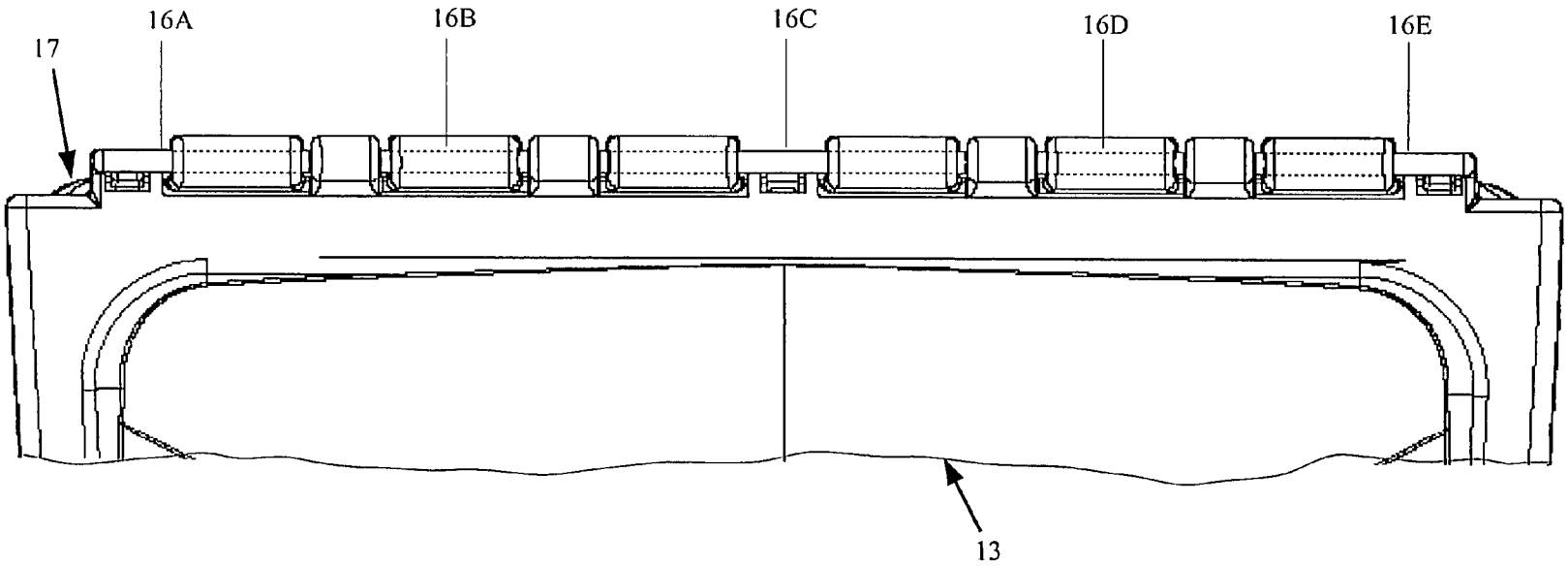
FIG. 11A is the top view of FIG. 11, but enlarged to show the portion of the storage bin near the hinge.
Figure 11B:
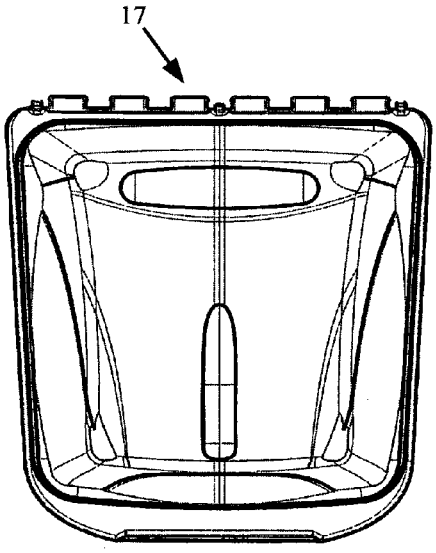
FIG. 11B and FIG. 11C show the container and the lid as seen in FIG. 11, but shown separated, and just prior to being assembled together.
Figure 11C:
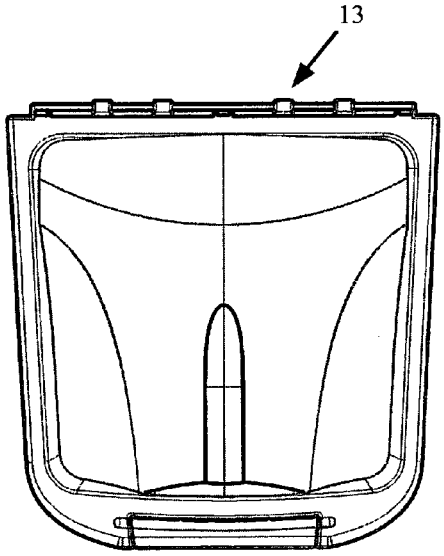
Figure 12:
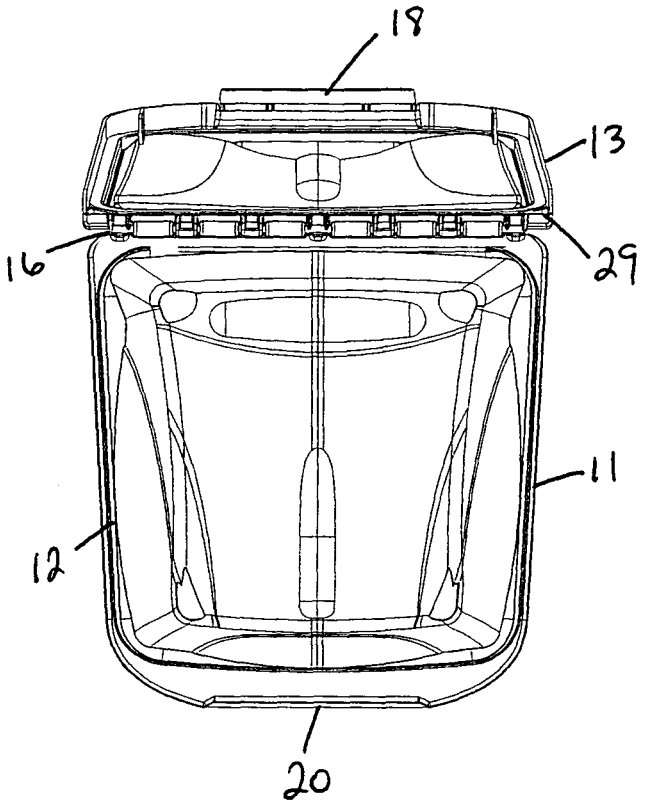
FIG. 12 is a top view of the container with the lid open.
Figure 13:
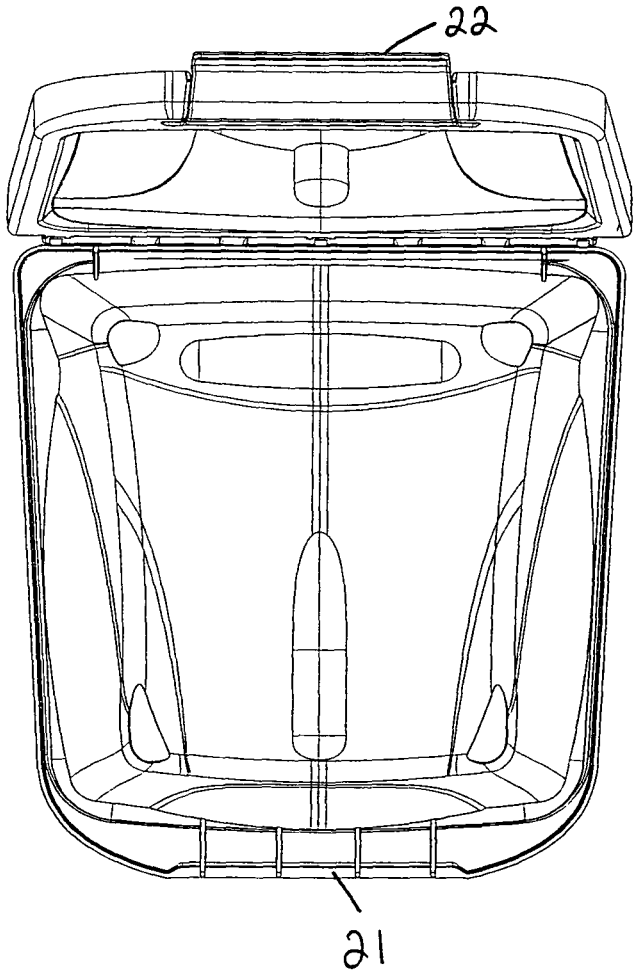
FIG. 13 is a bottom view of the container with the lid open.
Figure 14:
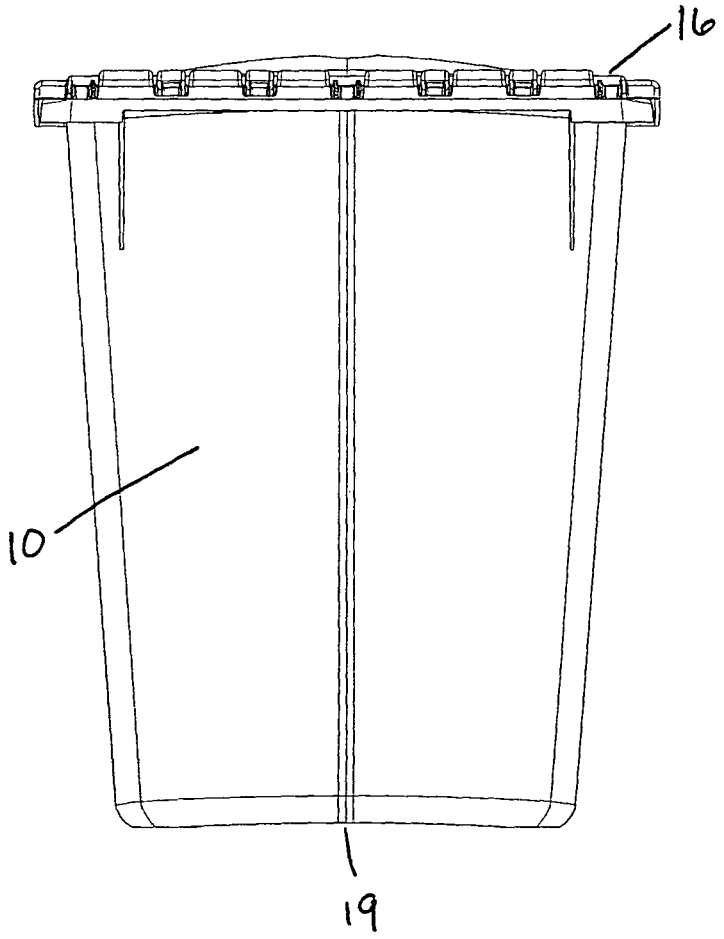
FIG. 14 shows a back view of the container with the lid closed.
Figure 15:
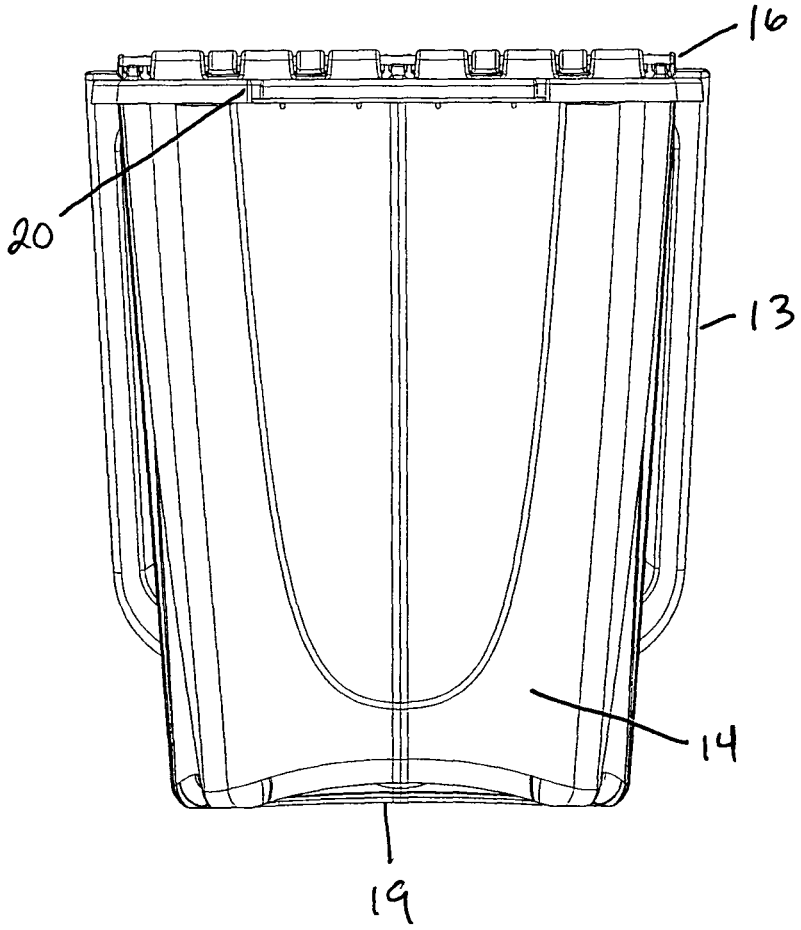
FIG. 15 is front view of the container with the lid open.
Figure 16:
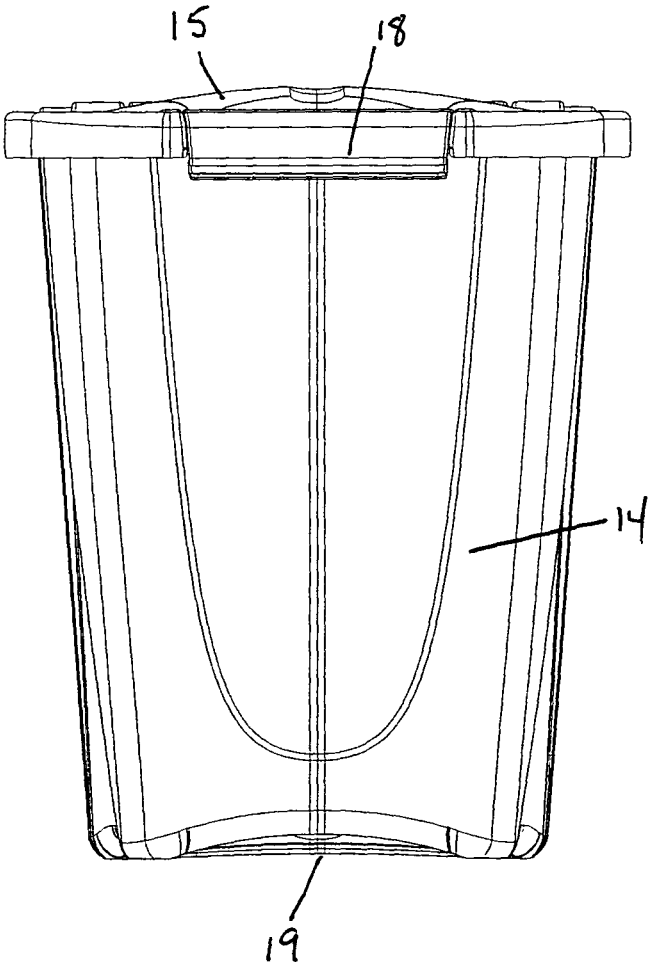
FIG. 16 is a front view of the container with the lid closed.
Figure 17:
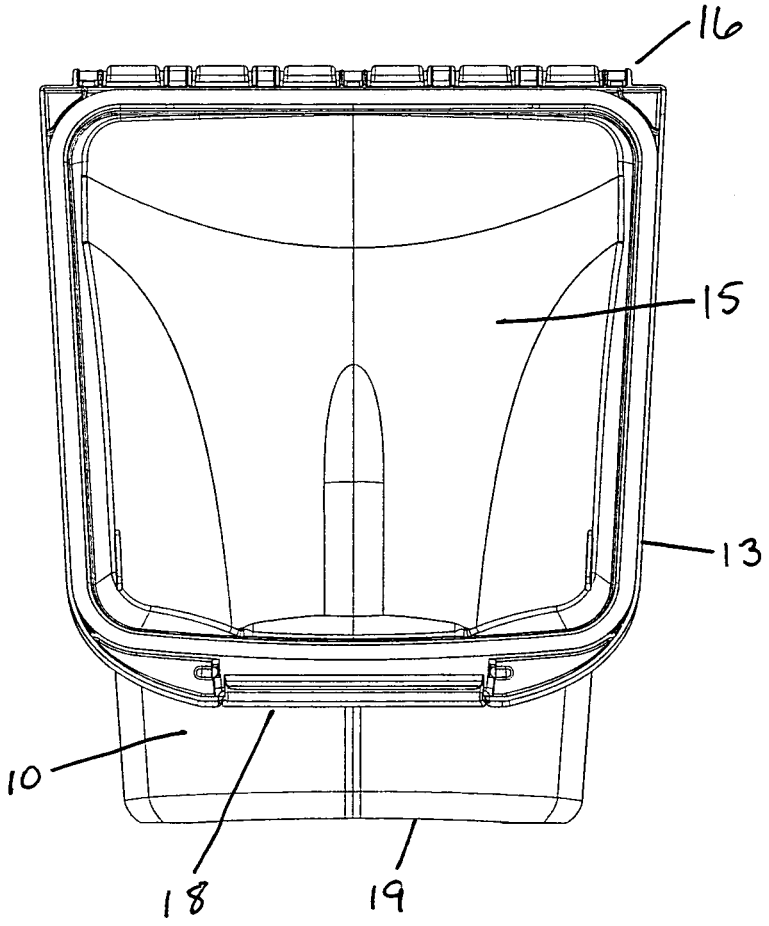
FIG. 17 is a rear view of the container with the lid open.
Figure 18:
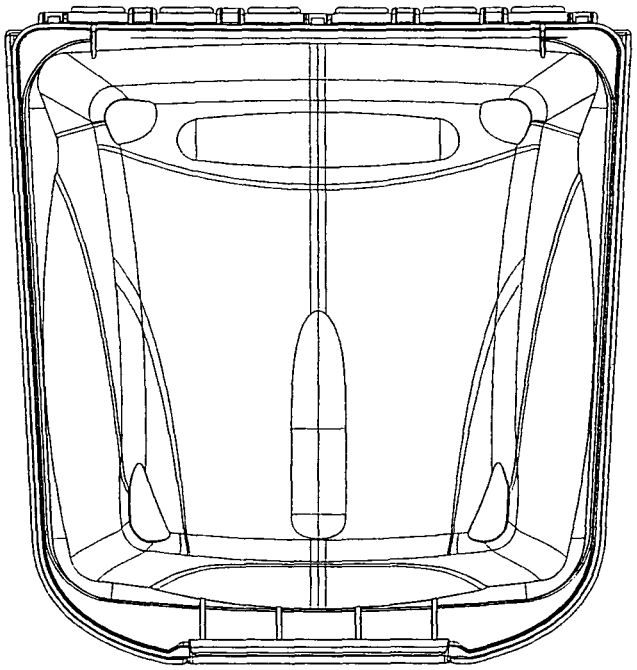
FIG. 18 is a top view of the container with the lid open.
Figure 19:
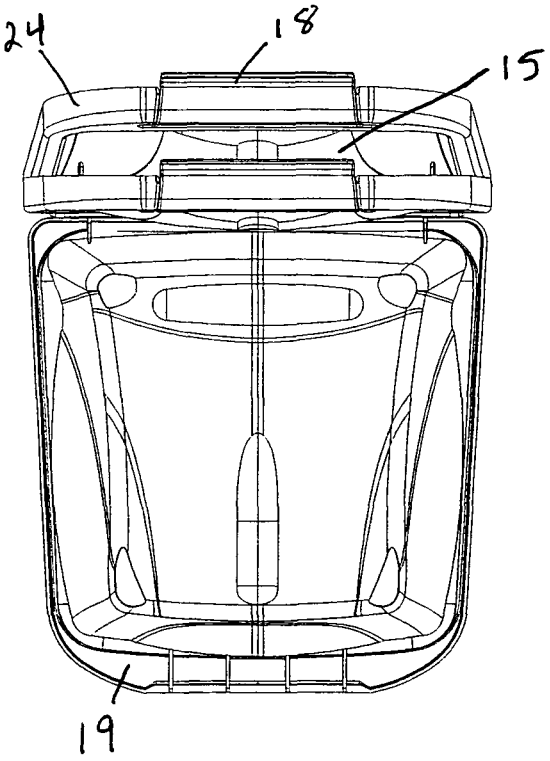
FIG. 19 is bottom view of the container with the lid open.

FIG. 2 is a perspective view showing the front end wall 14 and the first sidewall 11. As seen in FIG. 2, the front wall 14 can be slightly concave as can the sidewalls 11 and 12. FIG. 3 is a perspective view showing the front end wall 14 and the second sidewall 12. FIG. 4 is a perspective view of the food storage bin from the back of the bin 17 with the lid closed 13. FIG. 5 is a perspective view of the container 17 with the lid 13 closed showing the front end wall 14 and the second sidewall 12. FIG. 6 is a front perspective view of the bin 17 showing the front end wall 14 and the first sidewall 11. FIG. 7 is a side view of the container 17 with the lid 13 open showing the first sidewall 11. FIG. 8 is a side view of the container 17 with the lid 13 open from the opposite angle, showing the second sidewall 12. The lid may have a locking mechanism 18 on the lid. The mechanism may be a hinged. The mechanism may also be a piece of plastic molded to fit over the lip 20 on the container. FIG. 9 is a side view of the container 17 with the lid 13 closed, from an angle showing the first sidewall 11. FIG. 10 is a side view of the container 17 with the lid closed showing the second sidewall 12. FIG. 11 is a top view of the container 17 with the lid 13 closed. FIG. 12 is a top view of the container with the lid open. FIG. 13 is a bottom view of the container with the lid 13 open. FIG. 14 shows a rear view of the container 17 with the lid 13 in a closed position. FIG. 15 is front view of the container 17 with the lid open. FIG. 16 is a front view of the container 17 with the lid 13 closed. FIG. 17 is a rear view of the container 17 with the lid 13 open, showing the rear end wall 10. FIG. 18 is a top view of the container 17 with the lid 13 open. FIG. 19 is a bottom view of the container with the lid 13 open.

Figure 20:
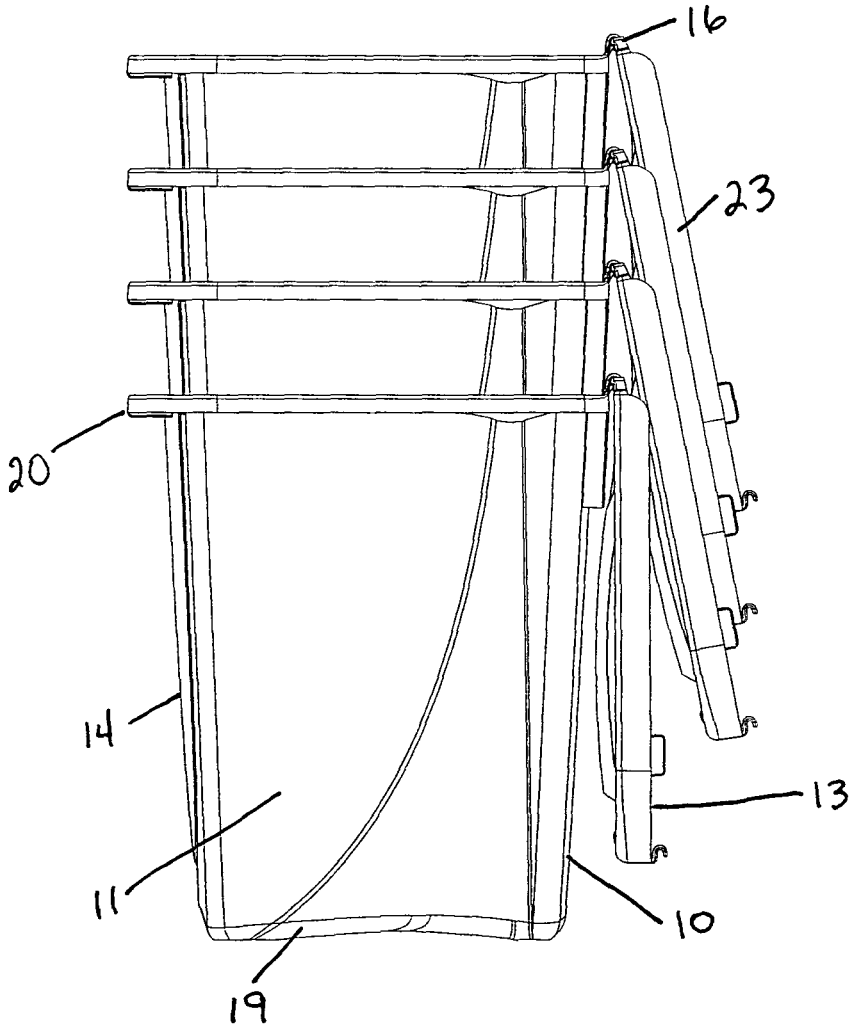
FIG. 20 shows a side view the containers nested within each other.
Figure 21:
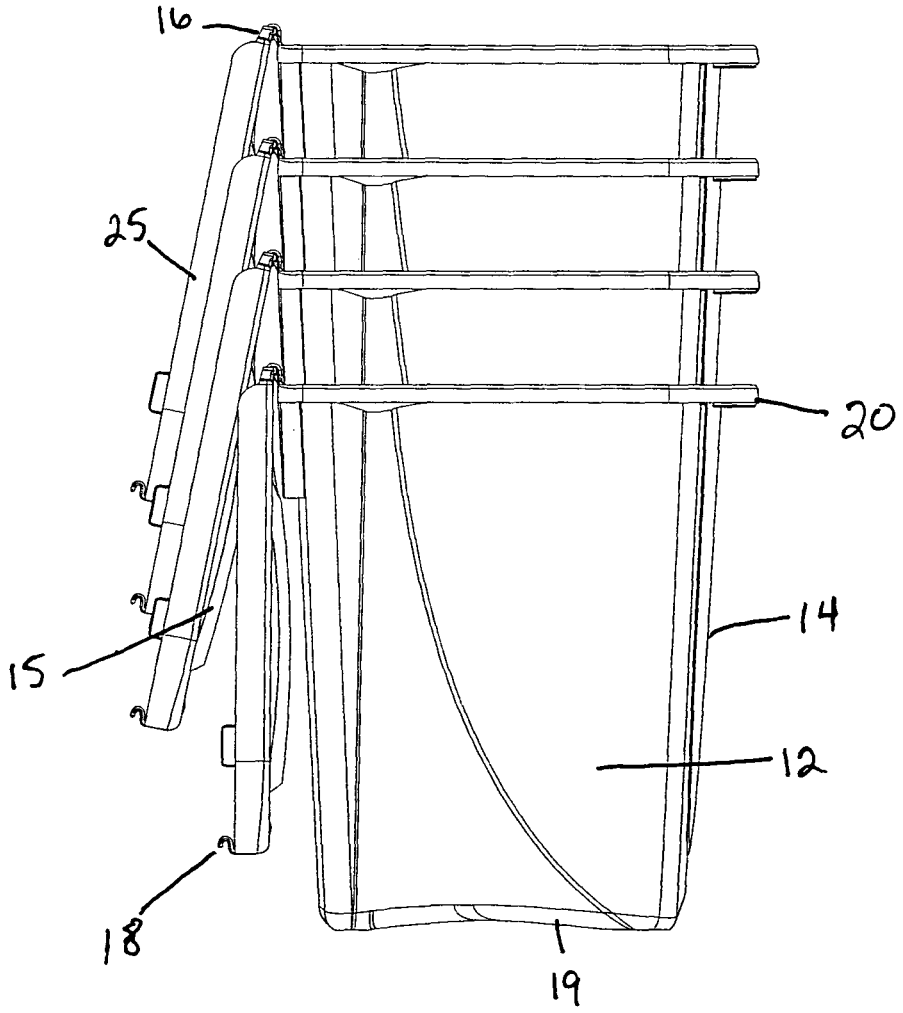
FIG. 21 is a side view of the containers nested in each other.
Figure 22:
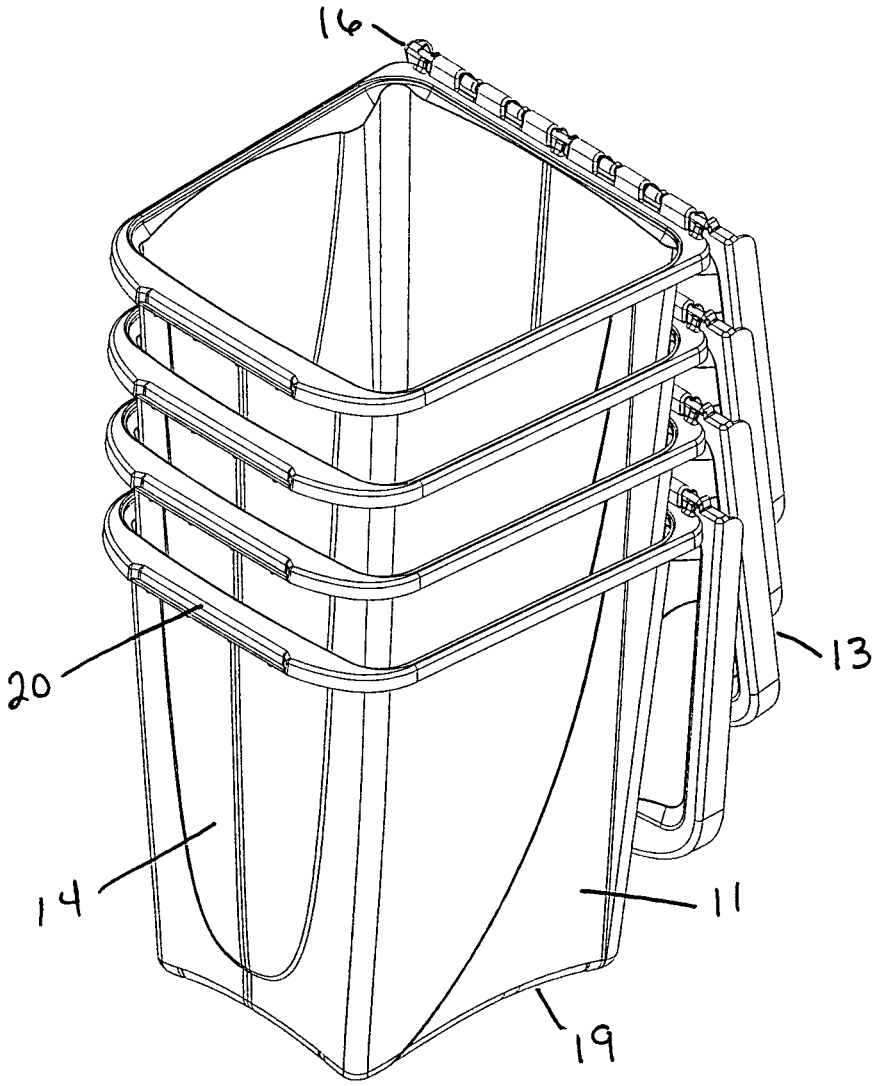
FIG. 22 is a perspective view of the containers nested, showing the front end wall.
Figure 23:
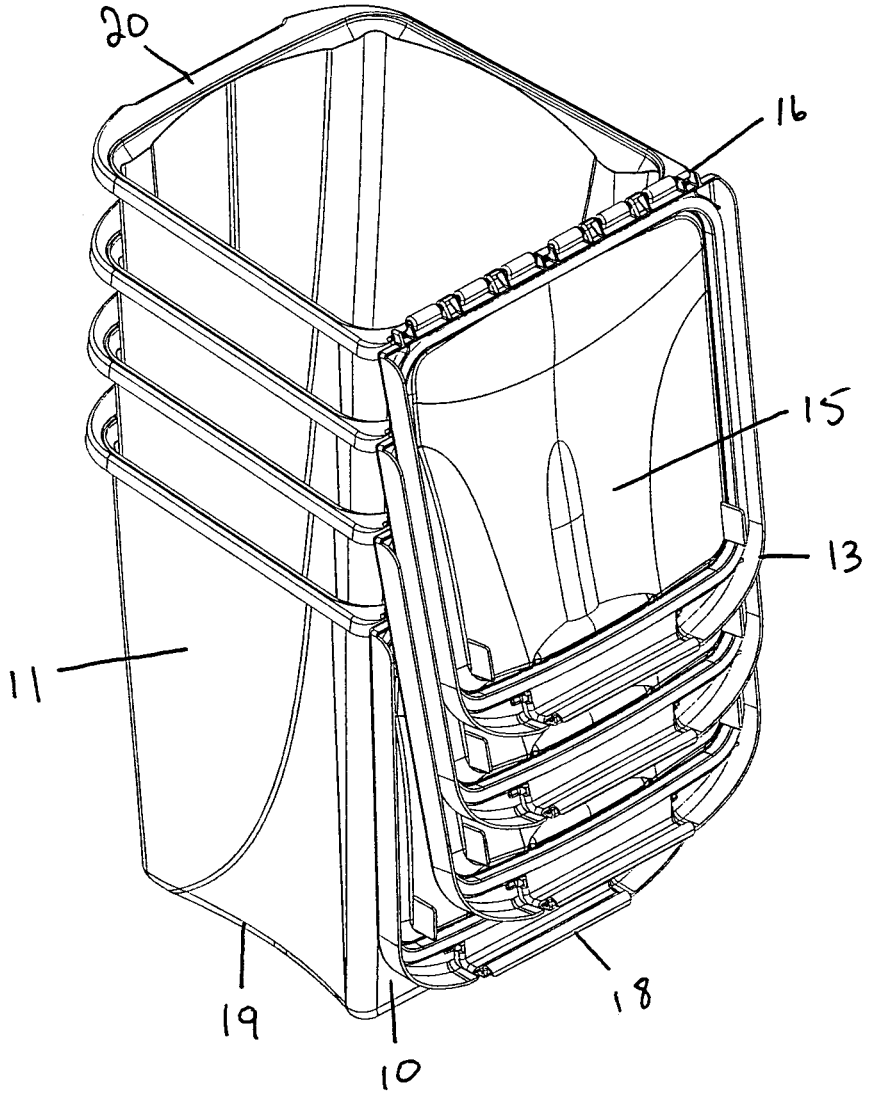
FIG. 23 is a perspective view of the containers nested within each other showing the second sidewall.
Figure 24:
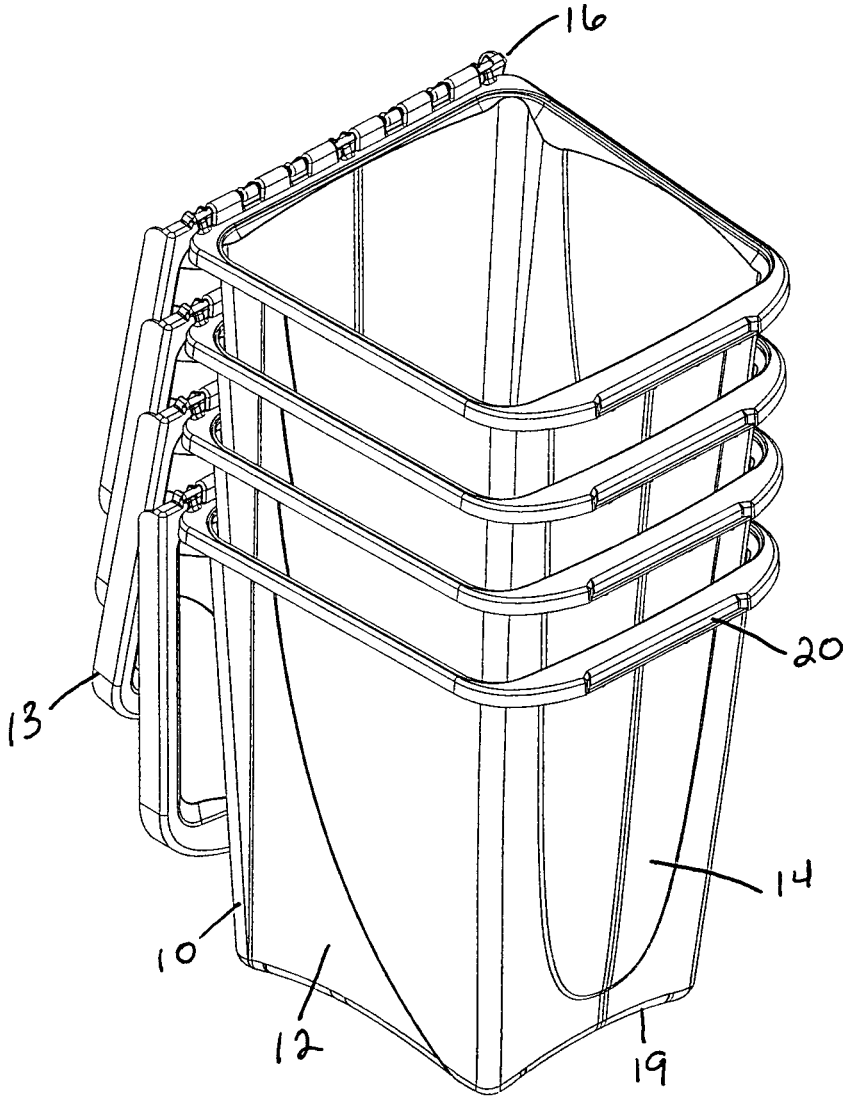
FIG. 24 is a front perspective view of the containers nested showing the second sidewall.
Figure 25:
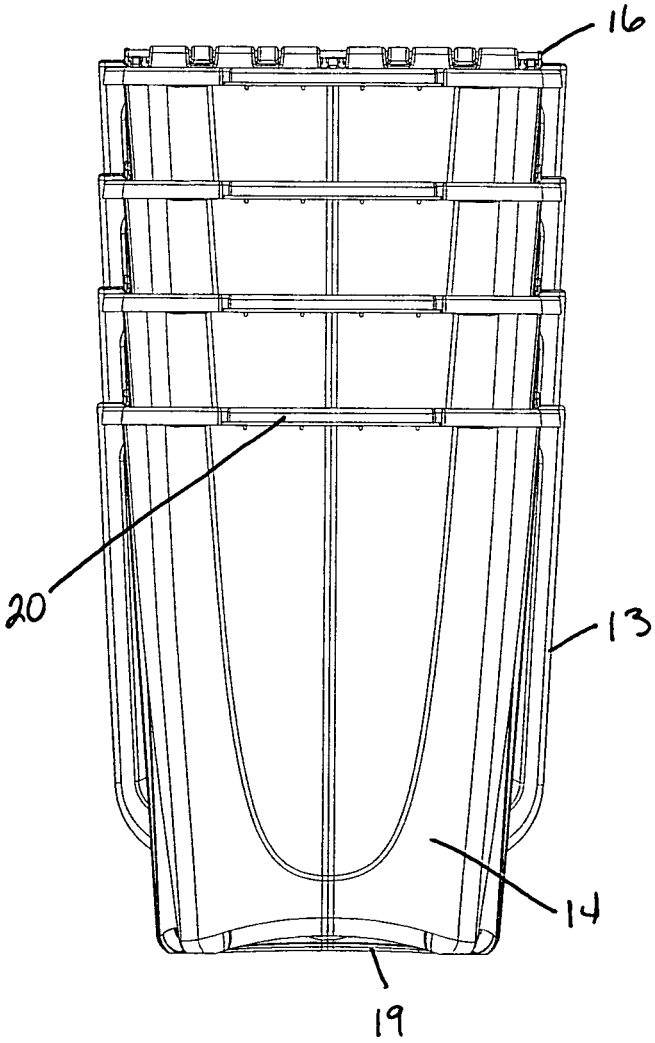
FIG. 25 is a front view of the containers nested.
Figure 26:
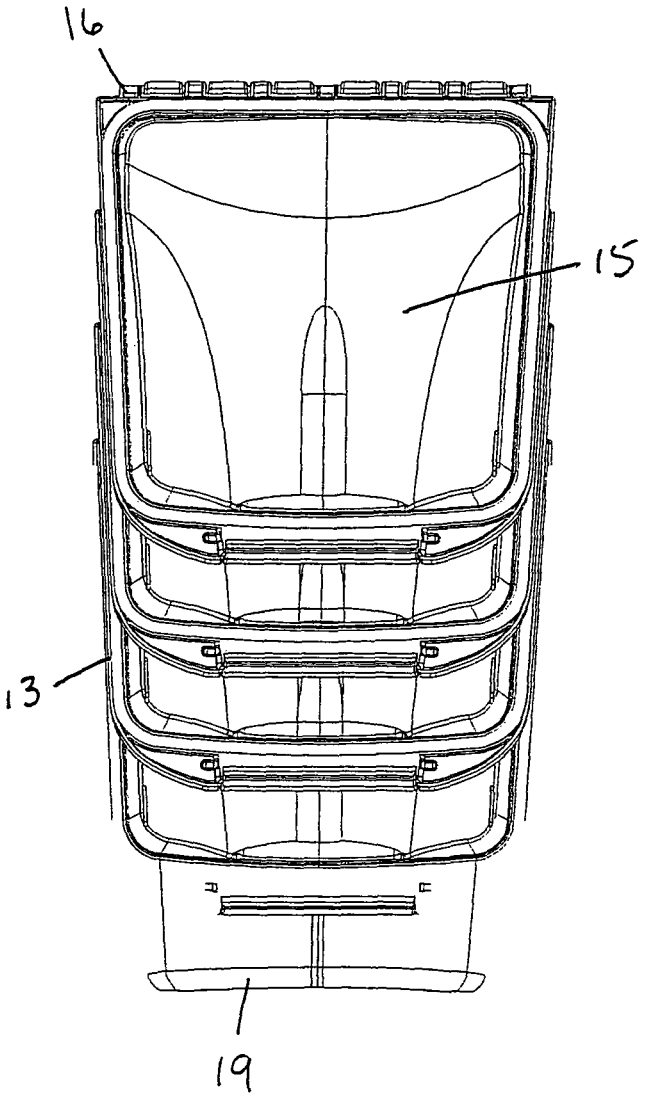
FIG. 26 is a rear view of the containers nested within each other.
Figure 27:
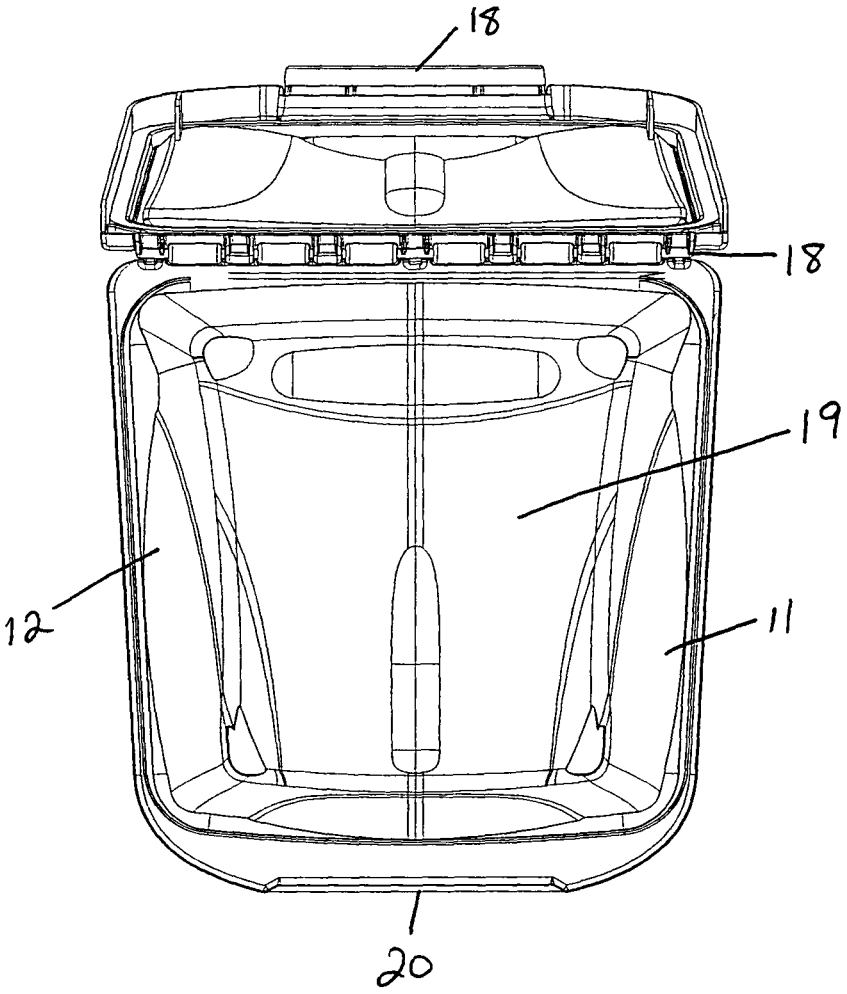
FIG. 27 is a top view of the containers.

FIG. 20 shows a side view of a plurality of the containers 17 nested in each other with the lid 13 open showing the first sidewall 11. FIG. 21 is a side view of the container 17 nested within each other with the lid 13 open showing the second sidewall 12. FIG. 21 is a side view of four containers 17 stacked within each other showing the second sidewall 12. FIGS. 20 and 21 show the containers are nested into one another, this causes the lids to also be somewhat nested into one another. FIG. 22 shows a perspective view of the containers nested into one another showing the front end wall 14 and the first sidewall 11. FIG. 23 is a perspective view of the containers nested in each other from the rear showing the first sidewall 11 the lids 13 and the rear end wall 10. FIG. 24 is a front perspective view of the containers nested within each other showing the second sidewall 12 and the front end wall 14. FIG. 25 is a front view of the containers nested within each other. FIG. 26 is a rear view of the containers nested within each other. FIG. 27 is a top view of a stack of containers with the lids nested as well as the containers.

I claim:

1. A combination container and lid, for use as an air-tight pet food storage bin, with said lid and said container configured to be easily joined during assembly, but further configured to be difficult to separate once assembled together and in subsequent use for storing pet food therein;

said lid comprising:

a top wall;

a lip extending away from at least a portion of said top wall;

a piano hinge pin; and two or more protrusions protruding from said top wall and configured to fixedly support said piano hinge pin;

said container comprising:

a base;

a first side wall and a second side wall, each said first and second side walls extending away from said base;

a front wall and a rear wall, each said front and rear walls extending away from said base, and each said front and rear walls also extending between said first side wall and said second side wall to form a cavity;

two or more hinge knuckles, each said two or more hinge knuckles comprising a hook protruding away from an end of said rear wall being distal from said base, each said hook configured to pivotally receive a portion of said piano hinge pin therein; and two or more elongated protrusions, each configured to respectively extend away from said end of said rear wall distal from said base and toward an axis of said two or more hooks, and each of said two or more elongated protrusions positioned proximate to a respective one of said hooks;

wherein said lid is pivotally joined with said container, by said piano hinge pin of said lid configured to be received, transversely with respect to said axis of said two or more hooks, through an opening between said two or more elongated protrusions and said hooks, to be pivotally received within said hooks; and wherein said piano hinge pin of said lid is retained in said pivotal relation with said hooks, by an end of each of said two or more elongated protrusions configured to engage and support said piano hinge pin, to impede removal of said piano hinge pin from said hooks, and to configure said pivotal joint to obstruct separation of said lid and said container once assembled together, said end of each said elongated protrusion comprising a truncated cylindrical surface.

2. The combination container and lid according to claim 1, wherein said truncated cylindrical surface at each said end of each of said elongated protrusions comprises a curved surface with an arc of less than 180 degrees.

3. The combination container and lid according to claim 2, wherein said lid comprises a lock member hinged to said lid, and configured to engage a lip on said container in a locked position.

4. A combination container and lid;

said lid comprising:

a top wall;

a lip extending away from at least a portion of said top wall;

a piano hinge pin; and two or more protrusions protruding from said top wall and configured to support said piano hinge pin;

said container comprising:

a base;

a first side wall and a second side wall, each extending away from said base;

a front wall and a rear wall, each extending away from said base, and each said front and rear walls also extending between said first side wall and said second side wall to form a cavity;

two or more hinge hooks protruding away from an end of said rear wall being distal from said base, each said hinge hook configured to pivotally receive a portion of said piano hinge pin therein; and two or more elongated protrusions, each configured to respectively extend away from said end of said rear wall distal from said base and toward an axis of said two or more hooks, and each of said two or more elongated protrusions positioned proximate to a respective one of said hooks;

wherein said lid is pivotally joined with said container, by said piano hinge pin of said lid configured to be received, transversely with respect to said axis of said two or more hooks, through an opening between said two or more elongated protrusions and said hooks, to be pivotally received within said hooks; and wherein said piano hinge pin of said lid is retained in said pivotal relation with said hooks, by an end of each of said two or more elongated protrusions configured to engage and support said piano hinge pin, to impede removal of said piano hinge pin from said hooks, and to configure said pivotal joint to obstruct separation of said lid and said container once assembled together, said end of each said elongated protrusion comprising a truncated cylindrical surface.

5. The combination container and lid according to claim 4, wherein said truncated cylindrical surface at each said end of each of said elongated protrusions comprises a curved surface with an arc of less than 180 degrees.

6. The combination container and lid according to claim 5 wherein each of said two or more hinge hooks and each of said two or more elongated protrusions are formed of a plastic material.

7. The combination container and lid according to claim 6, wherein said lid comprises a lock member hinged to said lid, and configured to engage a lip on said container in a locked position.

8. The combination container and lid according to claim 7 wherein said lock member is configured to provide an air tight seal between said lid and said container.

9. The combination container and lid according to claim 3 wherein each said hook of said two or more hinge knuckles and each of said two or more elongated protrusions are formed of a plastic material.

10. The combination container and lid according to claim 3 wherein said hinged lock member is configured to provide an air tight seal between said lid and said container.

* * * * *